US009236004B2

(12) United States Patent
Nakasu et al.

(10) Patent No.: US 9,236,004 B2
(45) Date of Patent: Jan. 12, 2016

(54) LIQUID CRYSTAL DISPLAY DEVICE

(75) Inventors: Hiroaki Nakasu, Osaka (JP); Kentaroh Irie, Osaka (JP); Masae Kawabata, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 177 days.

(21) Appl. No.: 14/131,512

(22) PCT Filed: Jul. 20, 2012

(86) PCT No.: PCT/JP2012/068423

§ 371 (c)(1),
(2), (4) Date: Jan. 8, 2014

(87) PCT Pub. No.: WO2013/015209

PCT Pub. Date: Jan. 31, 2013

(65) Prior Publication Data

US 2014/0139562 A1 May 22, 2014

(30) Foreign Application Priority Data

Jul. 28, 2011 (JP) ..... 2011-165114

(51) Int. Cl.
*G09G 3/20* (2006.01)
*G09G 3/36* (2006.01)

(52) U.S. Cl.
CPC ..... *G09G 3/2003* (2013.01); *G09G 3/3614* (2013.01); *G09G 3/3648* (2013.01); *G09G 2320/028* (2013.01)

(58) Field of Classification Search
CPC ..... G09G 3/3607; G09G 2310/027; G09G 3/2077; G09G 2320/0271; G09G 2310/0275; G09G 2310/0243
USPC ..... 345/87, 89, 690
See application file for complete search history.

(56) References Cited

U.S. PATENT DOCUMENTS 5,847,688 A 12/1998 Ohi et al.
2004/0183820 A1* 9/2004 Kawahara ..... G09G 3/20 345/690

(Continued)

FOREIGN PATENT DOCUMENTS

JP 7-121144 A 5/1995

OTHER PUBLICATIONS

Official Communication issued in International Patent Application No. PCT/JP2012/068423, mailed on Sep. 4, 2012.

*Primary Examiner* — Grant Sitta
*Assistant Examiner* — Amen Bogale
(74) *Attorney, Agent, or Firm* — Keating & Bennett

(57) ABSTRACT

In a liquid crystal display device adopting a time-division scheme to improve viewing angle characteristics, the occurrence of horizontal lines on a screen is suppressed. When first output gray scales are obtained for one-line data, the sum total of differences between "source voltages for a horizontal scanning period immediately before a horizontal scanning period during which a processing target line is placed in a selected state" and "source voltages determined based on the first output gray scales obtained by a gray scale value obtaining unit" for all source bus lines is determined (step S110). Then, based on the amount of CS ripple corresponding to the sum total determined at step S110, correction addition/subtraction values are obtained from a polarity-by-polarity background look-up table, for the respective picture elements included in the processing target line (step S120). Then, second output gray scales are determined in an addition/subtraction process of the first output gray scales and the correction addition/subtraction values (step S130).

11 Claims, 22 Drawing Sheets

(56) References Cited

U.S. PATENT DOCUMENTS

2005/0219161 A1* 10/2005 Aoki ..... G09G 3/3681 345/67
2008/0266213 A1* 10/2008 Kim ..... G09G 3/2803 345/63
2012/0229525 A1* 9/2012 Nakai ..... G09G 3/3688 345/690
2012/0249620 A1* 10/2012 Choi ..... G09G 3/3688 345/694

* cited by examiner

Fig.5

| GRAY SCALE VALUE | VH (POSITIVE POLARITY) | VL (NEGATIVE POLARITY) |
|---|---|---|
| 0 | 7.78 | 6.78 |
| 1 | 8.12 | 6.41 |
| 2 | 8.37 | 6.13 |
| 3 | 8.55 | 5.94 |
| 4 | 8.71 | 5.76 |
| 5 | 8.85 | 5.62 |
| 6 | 8.96 | 5.49 |
| 7 | 9.03 | 5.42 |
| 8 | 9.07 | 5.38 |
| 9 | 9.09 | 5.35 |
| 10 | 9.11 | 5.33 |
| 11 | 9.13 | 5.31 |
| 12 | 9.15 | 5.29 |
| 13 | 9.17 | 5.27 |
| 14 | 9.18 | 5.26 |
| 15 | 9.19 | 5.24 |
| 16 | 9.21 | 5.23 |
| 17 | 9.22 | 5.21 |
| 18 | 9.23 | 5.20 |
| 19 | 9.24 | 5.19 |
| 20 | 9.25 | 5.18 |
| ⋮ | ⋮ | ⋮ |

71

Fig.6

| | | CS RIPPLE AMOUNT | | | | | | | | | | | | | | | | | | | | | | |
|---|---|---|---|---|---|---|---|---|---|---|---|---|---|---|---|---|---|---|---|---|---|---|---|---|
| | | ··· | -8805 | -7925 | -7044 | -6164 | -5283 | -4403 | -3522 | -2642 | -1761 | -881 | 0 | 881 | 1761 | 2642 | 3522 | 4403 | 5283 | 6164 | 7044 | 7925 | 8805 | ··· |
| BACKGROUND GRAY SCALE | 0 | ··· | ··· | ··· | ··· | ··· | ··· | ··· | ··· | ··· | ··· | ··· | 0 | 0 | 1 | 1 | 1 | 2 | 2 | 2 | 2 | 3 | 3 | ··· |
| | · | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |
| | 15 | ··· | -3 | -3 | -3 | -2 | -2 | -2 | -1 | -1 | -1 | 0 | 0 | ··· | ··· | ··· | ··· | ··· | ··· | ··· | ··· | ··· | ··· | ··· |
| | · | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |
| | 262 | ··· | ··· | ··· | ··· | ··· | ··· | ··· | ··· | ··· | ··· | ··· | 0 | 7 | 21 | 25 | 28 | 35 | 42 | 49 | 56 | 63 | 69 | ··· |
| | · | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |
| | 696 | ··· | -92 | -83 | -74 | -64 | -55 | -45 | -36 | -32 | -27 | -10 | 0 | ··· | ··· | ··· | ··· | ··· | ··· | ··· | ··· | ··· | ··· | ··· |
| | · | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |
| | 1023 | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |

72

Fig.7

| | | CS RIPPLE AMOUNT | | | | | | | | | | | | | | | | | | | | | | |
|---|---|---|---|---|---|---|---|---|---|---|---|---|---|---|---|---|---|---|---|---|---|---|---|---|
| | | ··· | -8805 | -7925 | -7044 | -6164 | -5283 | -4403 | -3522 | -2642 | -1761 | -881 | 0 | 881 | 1761 | 2642 | 3522 | 4403 | 5283 | 6164 | 7044 | 7925 | 8805 | ··· |
| BACKGROUND GRAY SCALE | 0 | ··· | ··· | ··· | ··· | ··· | ··· | ··· | ··· | ··· | ··· | ··· | 0 | 0 | -1 | -1 | -1 | -1 | -2 | -2 | -2 | -2 | -3 | ··· |
| | · | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |
| | 15 | ··· | 3 | 3 | 3 | 2 | 2 | 1 | 1 | 1 | 1 | 0 | 0 | ··· | ··· | ··· | ··· | ··· | ··· | ··· | ··· | ··· | ··· | ··· |
| | · | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |
| | 262 | ··· | ··· | ··· | ··· | ··· | ··· | ··· | ··· | ··· | ··· | ··· | 0 | -6 | -20 | -24 | -28 | -36 | -43 | -50 | -57 | -64 | -71 | ··· |
| | · | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |
| | 557 | ··· | 87 | 78 | 70 | 62 | 53 | 44 | 35 | 31 | 27 | 9 | 0 | ··· | ··· | ··· | ··· | ··· | ··· | ··· | ··· | ··· | ··· | ··· |
| | · | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |
| | 1023 | ··· | ··· | ··· | ··· | ··· | ··· | ··· | ··· | ··· | ··· | ··· | 0 | ··· | ··· | ··· | ··· | ··· | ··· | ··· | ··· | ··· | ··· | ··· |

Fig.10

| | | HORIZONTAL COORDINATE | | | | | | | | | | | | | | | |
|---|---|---|---|---|---|---|---|---|---|---|---|---|---|---|---|---|---|
| | | 0 | 128 | 256 | 384 | 512 | 640 | 768 | 896 | 1024 | 1152 | 1280 | 1408 | 1536 | 1664 | 1792 | 1920 |
| VERTICAL COORDINATE | 0 | 0.48 | 0.49 | 0.49 | 0.49 | 0.50 | 0.50 | 0.50 | 0.50 | 0.50 | 0.50 | 0.50 | 0.50 | 0.49 | 0.49 | 0.49 | 0.48 |
| | 128 | 0.58 | 0.58 | 0.59 | 0.59 | 0.59 | 0.60 | 0.60 | 0.60 | 0.60 | 0.60 | 0.60 | 0.59 | 0.59 | 0.59 | 0.58 | 0.58 |
| | 256 | 0.67 | 0.68 | 0.69 | 0.69 | 0.69 | 0.70 | 0.70 | 0.70 | 0.70 | 0.70 | 0.70 | 0.69 | 0.69 | 0.69 | 0.68 | 0.67 |
| | 384 | 0.77 | 0.78 | 0.78 | 0.79 | 0.79 | 0.80 | 0.80 | 0.80 | 0.80 | 0.80 | 0.80 | 0.79 | 0.79 | 0.78 | 0.78 | 0.77 |
| | 512 | 0.86 | 0.87 | 0.88 | 0.89 | 0.89 | 0.90 | 0.90 | 0.90 | 0.90 | 0.90 | 0.90 | 0.89 | 0.89 | 0.88 | 0.87 | 0.86 |
| | 640 | 0.96 | 0.97 | 0.98 | 0.99 | 0.99 | 1.00 | 1.00 | 1.00 | 1.00 | 1.00 | 1.00 | 0.99 | 0.99 | 0.98 | 0.97 | 0.96 |
| | 768 | 0.99 | 1.00 | 1.01 | 1.01 | 1.02 | 1.02 | 1.03 | 1.03 | 1.03 | 1.03 | 1.02 | 1.02 | 1.01 | 1.01 | 1.00 | 0.99 |
| | 896 | 1.01 | 1.02 | 1.03 | 1.03 | 1.04 | 1.04 | 1.05 | 1.05 | 1.05 | 1.05 | 1.04 | 1.04 | 1.03 | 1.03 | 1.02 | 1.01 |
| | 1024 | 1.06 | 1.07 | 1.08 | 1.08 | 1.09 | 1.09 | 1.10 | 1.10 | 1.10 | 1.10 | 1.09 | 1.09 | 1.08 | 1.08 | 1.07 | 1.06 |
| | 1080 | 1.15 | 1.16 | 1.18 | 1.18 | 1.19 | 1.19 | 1.20 | 1.20 | 1.20 | 1.20 | 1.19 | 1.19 | 1.18 | 1.18 | 1.16 | 1.15 |

| INPUT GRAY SCALE | OUTPUT GRAY SCALE | |
|---|---|---|
| | BRIGHT PIXEL | DARK PIXEL |
| 0 | 0 | 0 |
| ⋮ | ⋮ | ⋮ |
| 64 | 96 | 8 |
| ⋮ | ⋮ | ⋮ |
| 192 | 240 | 32 |
| ⋮ | ⋮ | ⋮ |
| 255 | 255 | 255 |

87

LIQUID CRYSTAL DISPLAY DEVICE

TECHNICAL FIELD

The present invention relates to a liquid crystal display device, and more particularly to a liquid crystal display device that performs display with target luminance by temporally dividing the display into display with relatively bright luminance and display with relatively dark luminance in order to improve viewing angle characteristics.

BACKGROUND ART

For liquid crystal display devices, various techniques for improving viewing angle characteristics are conventionally proposed. As techniques for improving viewing angle characteristics, there are known, for example, a scheme in which "one picture element is composed of a plurality of (typically, two) sub-picture elements, and liquid crystal is driven such that the luminances of the plurality of sub-picture elements differ from each other" (hereinafter, referred to as the "space-division scheme") and a scheme in which "for display at each picture element, display with desired luminance is performed by dividing a unit period (a period for displaying a one-screen image) into a period during which display with relatively bright luminance (hereinafter, referred to as "bright display") is performed and a period during which display with relatively dark luminance (hereinafter, referred to as "dark display") is performed" (hereinafter, referred to as the "time-division scheme").

FIG. 13 is a circuit diagram showing a configuration of a portion forming one picture element (hereinafter, referred to as a "picture element portion") in a liquid crystal display device adopting the space-division scheme. As shown in FIG. 13, a picture element portion 80 is composed of two sub-picture element portions (a first sub-picture element portion PIX81 and a second sub-picture element portion PIX82). Both of the sub-picture element portions (PIX81 and PIX82) include thin-film transistors (T81 and T82) connected at their gate electrodes to a gate bus line (scanning signal line) GL and connected at their source electrodes to a source bus line (video signal line) SL; pixel electrodes (E81 and E82) connected to the drain electrodes of the thin-film transistors (T81 and T82); liquid crystal capacitances (Clc81 and Clc82) formed by the pixel electrodes (E81 and E82) and a common electrode EC; and auxiliary capacitances (Ccs81 and Ccs81) formed by the pixel electrodes (E81 and E82) and CS bus lines (auxiliary capacitance wiring lines) (CSL81 and CSL82). Note that a pixel capacitance is formed by the liquid crystal capacitance and the auxiliary capacitance, and a constant voltage VCOM is provided to the common electrode EC. In such a configuration, when the gate bus line GL is placed in a selected state, the thin-film transistors T81 and T82 are placed in an on state. Since the source electrode of the thin-film transistor T81 in the first sub-picture element portion PIX81 and the source electrode of the thin-film transistor T82 in the second sub-picture element portion PIX82 are connected to the same source bus line SL, the voltage of the pixel electrode E81 in the first sub-picture element portion PIX81 and the voltage of the pixel electrode E82 in the second sub-picture element portion PIX82 are equal to each other. Thereafter, one of the voltages on the CS bus lines CSL81 and CSL82 is allowed to increase and the other one of the voltages is allowed to decrease, by which the voltage of the pixel electrode E81 and the voltage of the pixel electrode E82 change in opposite directions. By this, the pixel electrode E81 and the pixel electrode E82 have different voltages and thus the first sub-picture element portion PIX81 and the second sub-picture element portion PIX82 have different luminances. As a result, viewing angle characteristics are improved.

In a liquid crystal display device adopting the time-division scheme, a unit period for displaying a one-screen image consists of, for example, four frames. When taking a look at the four frames, the display state of each pixel changes in the manner shown in, for example, FIG. 14. In the example shown in FIG. 14, some pixels change in their display states in the manner "dark display, dark display, bright display, and bright display" and some pixels change in their display states in the manner "bright display, bright display, dark display, and dark display". By thus performing display with target luminance using a bright display period and a dark display period, viewing angle characteristics are improved. Note that when the display state changes in the unit of picture elements instead of the unit of pixels, too, viewing angle characteristics are improved in the same manner.

In a liquid crystal display device adopting the space-division scheme or the time-division scheme, the voltage-transmittance characteristics are represented by two curves (two VT curves). For example, when an input signal with a gray scale value associated with a voltage denoted by reference character V1 in FIG. 15 is provided, for a pixel where bright display is to be performed (hereinafter, referred to as a "bright pixel"), the source voltage is determined based on a VT curve denoted by reference character 83 so as to obtain transmittance denoted by reference character T1, and for a pixel where dark display is to be performed (hereinafter, referred to as a "dark pixel"), the source voltage is determined based on a VT curve denoted by reference character 84 so as to obtain transmittance denoted by reference character T2. A correspondence relationship between an input gray scale (a gray scale value represented by an input signal) and an output gray scale (a gray scale value directly used to determine a source voltage) is, for example, represented by a curve denoted by reference character 85 in FIG. 16 for the bright pixel, and represented by a curve denoted by reference character 86 in FIG. 16 for the dark pixel. Note that data representing such correspondence relationships is typically stored in a look-up table in which input gray scales are associated with output gray scales for the bright pixel and the dark pixel (hereinafter, referred to as the "gray scale value conversion look-up table"). Although here description is made assuming that "bright" and "dark" are arranged in the unit of pixels, the same also applies to the case in which "bright" and "dark" are arranged in the unit of picture elements.

FIG. 17 is a diagram schematically showing an example of the gray scale value conversion look-up table. In FIG. 17, for example, a row denoted by reference character 87 refers to that "when the input gray scale is 192, the output gray scale is 240 for the bright pixel and the output gray scale is 32 for the dark pixel". Therefore, in the case in which a liquid crystal display device adopting the time-division scheme uses the gray scale value conversion look-up table shown in FIG. 17, when there is included data with an input gray scale of 192, the output gray scale of a pixel associated with the data changes in the manner shown in, for example, FIG. 18. Note that an invention of a liquid crystal display device that adopts a time-division scheme such as that described above to improve viewing angle characteristics is disclosed in, for example, Japanese Patent Application Laid-Open No. 7-121144.

PRIOR ART DOCUMENT

Patent Document

[Patent Document 1] Japanese Patent Application Laid-Open No. 7-121144

SUMMARY OF THE INVENTION

Problems to be Solved by the Invention

However, a liquid crystal display device adopting the time-division scheme has a problem of the occurrence of horizontal lines on a screen, which will be described below. Note that in the following a set of picture elements included in the same row is referred to as a "line", and a line that is a processing target for performing writing (charging of pixel capacitances in picture element portions) is referred to as a "processing target line".

A liquid crystal display device may perform image display using a part (typically, a central portion) of the display unit, instead of performing image display using the entire display unit. In such a liquid crystal display device, for example, as shown in FIG. 19, a window portion 120 for displaying an image is provided at a central portion of a display unit 100, and a background portion 110 for displaying background color is provided around the window portion 120. In general, a predetermined color such as gray or black is displayed on the background portion 110, and a still image/moving image according to a user's request is displayed on the window portion 120. Under such an assumption, eight pixels (pixels of two columns×four rows) present in a region denoted by reference character 88 in FIG. 20 are taken a look at. For those eight pixels, it is assumed that, as shown in FIG. 21, four pixels located in an upper area are included in the background portion 110, and four pixels located in a lower area are included in the window portion 120. Note that in the case of a color liquid crystal display device, one pixel is composed of a plurality of picture elements. FIG. 22 shows an example in which one pixel is composed of three picture elements, red (R), green (G), and blue (B), and an example in which one pixel is composed of four picture elements, yellow (Y), red (R), green (G), and blue (B). In the following, description is made taking a look at the example in which one pixel is composed of three picture elements, red (R), green (G), and blue (B).

When taking a look at the display state of each pixel in any frame during a unit period, for two pixels adjacent to each other in the vertical direction or the horizontal direction, one is bright display and the other is dark display (see FIG. 21). Now, the case is considered in which the background portion 110 is gray display and the window portion 120 is green display. Note that it is assumed that the input gray scales for the background portion 110 are "R=64, G=64, and B=64" and the input gray scales for the window portion 120 are "R=0, G=192, and B=0". In this state, the output gray scales of picture elements included in the above-described eight pixels in a certain frame are those shown in FIG. 23, according to the gray scale value conversion look-up table shown in FIG. 17. In FIG. 23, for example, a picture element denoted by reference character 89 indicates that the output gray scale is 96 and the polarity is positive. Note that in the following, for example, a column of green picture elements among the first columns in FIG. 23 is referred to as the "column G1".

Next, with reference to FIGS. 23 and 24, changes in source voltage when transitioning from the period of writing to the background portion 110 to the period of writing to the window portion 120 will be described. Note that here it is assumed that the gate bus lines are selected every other row. Therefore, during a horizontal scanning period subsequent to a horizontal scanning period during which writing to the Nth line is performed, writing to the (N+2)th line is performed. FIG. 24 shows changes in the voltages (source voltages) of source bus lines SL provided to column R1, column G1, column B1, column R2, column G2, and column B2, respectively, and in the voltages of CS bus lines CSL. Note that in FIG. 24 the time point when writing to the (N+2)th line starts is denoted by reference character t0. For the column R1, the voltage changes from a positive-polarity voltage corresponding to a gray scale value of 96 to a positive-polarity voltage corresponding to a gray scale value of 0. For the column G1, the voltage changes from a negative-polarity voltage corresponding to a gray scale value of 96 to a negative-polarity voltage corresponding to a gray scale value of 240. The column B1 is the same as the column R1. For the column R2, the voltage changes from a negative-polarity voltage corresponding to a gray scale value of 8 to a negative-polarity voltage corresponding to a gray scale value of 0. For the column G2, the voltage changes from a positive-polarity voltage corresponding to a gray scale value of 8 to a positive-polarity voltage corresponding to a gray scale value of 32. The column B2 is the same as the column R2. As is grasped from the above, when transitioning from the period of writing to the background portion 110 to the period of writing to the window portion 120, the source voltages overall change in the negative direction.

Meanwhile, a picture element portion forming one picture element is, as shown in FIG. 25, composed of a gate bus line GL; a source bus line SL; a common electrode EC; a CS bus line CSL; a thin-film transistor (TFT) 101 connected at its gate electrode to the gate bus line GL and connected at its source electrode to the source bus line SL; a pixel electrode 102 connected to the drain electrode of the thin-film transistor 101; a liquid crystal capacitance 103 formed by the pixel electrode 102 and the common electrode EC; and an auxiliary capacitance 104 formed by the pixel electrode 102 and the CS bus line CSL. In such a configuration, a parasitic capacitance is formed, as indicated by reference character C9 in FIG. 25, between the source bus line SL and the CS bus line CSL. In addition, as described above, when transitioning from the period of writing to the background portion 110 to the period of writing to the window portion 120 (time point t0 in FIG. 24), the source voltages overall change in the negative direction. Accordingly, at time point t0, due to the presence of a parasitic capacitance C9 between the source bus line SL and the CS bus line CSL, as indicated by reference character 90 in FIG. 24, a ripple (hereinafter, referred to as a "CS ripple") in the negative direction occurs in the voltage of the CS bus line CSL.

After time point t0, the CS ripple is attenuated, i.e., the magnitude of the CS ripple gradually decreases. However, if, as shown in FIG. 26, the magnitude of the CS ripple does not become sufficiently small before time point t1 where the period of writing to the (N+2)th line is completed, then since the gate bus line GL is placed in a non-selected state and accordingly the thin-film transistor 101 (see FIG. 25) is placed in an off state at time point t1, after time point t1 pixel electrode voltages (VD(+) and VD(−) in FIG. 26) also change with the change in voltage of the CS bus line CSL. In the example shown in FIG. 26, since the voltage of the CS bus line CSL increases during a period from time point t1 to time point t2, the pixel electrode voltages also increase during the period. Due to this, in a picture element portion where the polarity is to be made positive, despite the fact that a voltage of a magnitude denoted by reference character 91 is to be originally applied to the liquid crystal layer, a voltage of a magnitude denoted by reference character 92 is applied to the liquid crystal layer. In addition, in a picture element portion where the polarity is to be made negative, despite the fact that a voltage of a magnitude denoted by reference character 93 is to be originally applied to the liquid crystal layer, a voltage of a magnitude denoted by reference character 94 is applied to the liquid crystal layer.

In addition, in the liquid crystal display device, when transitioning from the period of writing to the window portion 120 to the period of writing to the background portion 110, the source voltages overall change in the positive direction. Hence, as shown in FIG. 27, a CS ripple in the positive direction occurs at time point t10 when the period of writing to the background portion 110 starts. Due to the CS ripple, in a picture element portion where the polarity is to be made positive, despite the fact that a voltage of a magnitude denoted by reference character 95 is to be originally applied to the liquid crystal layer, a voltage of a magnitude denoted by reference character 96 is applied to the liquid crystal layer. In addition, in a picture element portion where the polarity is to be made negative, despite the fact that a voltage of a magnitude denoted by reference character 97 is to be originally applied to the liquid crystal layer, a voltage of a magnitude denoted by reference character 98 is applied to the liquid crystal layer.

As described above, when transitioning from the period of writing to the background portion 110 to the period of writing to the window portion 120 and when transitioning from the period of writing to the window portion 120 to the period of writing to the background portion 110, a voltage different from a voltage that is to be originally applied to the liquid crystal layer is applied to the liquid crystal layer. As a result, horizontal lines such as those shown in FIG. 28 appear on a screen.

An object of the present invention is therefore to suppress the occurrence of horizontal lines on a screen in a liquid crystal display device that adopts the time-division scheme to improve viewing angle characteristics.

Means for Solving the Problems

A first aspect of the present invention is directed to a liquid crystal display device that includes a display unit including: a plurality of video signal lines for transmitting video signals; a plurality of scanning signal lines arranged so as to intersect the plurality of video signal lines, and selected horizontal scanning period by horizontal scanning period; a plurality of pixel electrodes provided at respective intersections of the plurality of video signal lines and the plurality of scanning signal lines; and a plurality of auxiliary capacitance wiring lines arranged so as to intersect the plurality of video signal lines to form auxiliary capacitances with the plurality of pixel electrodes, and that displays an image based on an input signal on the display unit by applying the video signals to the plurality of video signal lines such that voltages determined based on the input signal representing gray scale values are provided to the pixel electrodes, the liquid crystal display device comprising:

an output gray scale correction processing unit that determines second output gray scales associated with video signal voltages to be applied to the plurality of video signal lines, by correcting first output gray scales determined based on line data on a line-data-by-line-data basis, the line data being data for one horizontal scanning period included in the input signal, wherein when a horizontal scanning period during which the video signals are to be applied to the plurality of video signal lines based on line data subjected to a process of determining the second output gray scales is defined as a processing target horizontal scanning period, a horizontal scanning period immediately before the processing target horizontal scanning period is defined as a preceding horizontal scanning period, and a sum total of differences, for the plurality of video signal lines, between video signal voltages associated with second output gray scales determined based on line data for the preceding horizontal scanning period and video signal voltages associated with first output gray scales determined based on line data for the processing target horizontal scanning period is defined as a sum total of voltage differences, the output gray scale correction processing unit determines the second output gray scales by correcting the first output gray scales, based on the sum total of voltage differences.

According to a second aspect of the present invention, in the first aspect of the present invention, the output gray scale correction processing unit:

sets the second output gray scale to a value greater than or equal to the first output gray scale when the sum total of voltage differences has a positive value, and sets the second output gray scale to a value less than or equal to the first output gray scale when the sum total of voltage differences has a negative value, for data corresponding to a pixel electrode to which a positive voltage is to be applied during the processing target horizontal scanning period out of the line data; and sets the second output gray scale to a value less than or equal to the first output gray scale when the sum total of voltage differences has a positive value, and sets the second output gray scale to a value greater than or equal to the first output gray scale when the sum total of voltage differences has a negative value, for data corresponding to a pixel electrode to which a negative voltage is to be applied during the processing target horizontal scanning period out of the line data.

According to a third aspect of the present invention, in the second aspect of the present invention, when there are a plurality of data whose values of the first output gray scales are equal, the output gray scale correction processing unit makes a difference between the first output gray scale and the second output gray scale larger for a larger absolute value of the sum total of voltage differences, for the plurality of data.

According to a fourth aspect of the present invention, in the first aspect of the present invention, the liquid crystal display device further comprises output gray scale correction look-up tables for the respective polarities of the voltages to be applied to the pixel electrodes, each of the output gray scale correction look-up tables storing a correspondence relationship between a combination of a value corresponding to the sum total of voltage differences and the first output gray scale, and a correction addition/subtraction value being a value used to correct the first output gray scale, wherein the output gray scale correction processing unit sets the second output gray scale to a value obtained by an addition/subtraction process of a correction addition/subtraction value and the first output gray scale, the correction addition/subtraction value being obtained from the output gray scale correction look-up tables based on a combination of a value corresponding to the sum total of voltage differences and the first output gray scale.

According to a fifth aspect of the present invention, in the fourth aspect of the present invention, the output gray scale correction processing unit multiplies the correction addition/subtraction value by a multiplying factor determined in advance according to a position in the display unit, before performing the addition/subtraction process of the correction addition/subtraction value and the first output gray scale.

According to a sixth aspect of the present invention, in the fifth aspect of the present invention, the liquid crystal display device further comprises a multiplying factor look-up table storing a correspondence relationship between a position in the display unit and a multiplying factor used to correct the correction addition/subtraction value, wherein the output gray scale correction processing unit multiplies the correction addition/subtraction value by a multiplying factor obtained from the multiplying factor look-up table based on a position in the display unit for each data.

According to a seventh aspect of the present invention, in the first aspect of the present invention, the liquid crystal display device further comprises a gray scale value obtaining unit that determines, as the first output gray scales, a first output gray scale for bright display for performing relatively bright display and a first output gray scale for dark display for performing relatively dark display, based on the gray scale values represented by respective data included in the input signal, wherein a one-screen image is displayed over a plurality of frame periods, and when taking a look at each data included in the input signal, during one-half of the plurality of frame periods, a video signal voltage associated with a second output gray scale determined by correcting the first output gray scale for bright display is applied to a pixel electrode associated with the data, and during remaining half of the plurality of frame periods, a video signal voltage associated with a second output gray scale determined by correcting the first output gray scale for dark display is applied to the pixel electrode associated with the data.

According to an eighth aspect of the present invention, in the first aspect of the present invention, the display unit includes a first display unit that performs display of an image based on a constant gray scale value; and a second display unit that performs display of an image based on any gray scale, the second display unit being in a region other than the first display unit.

A ninth aspect of the present invention is directed to a drive method for a liquid crystal display device that includes a display unit including: a plurality of video signal lines for transmitting video signals; a plurality of scanning signal lines arranged so as to intersect the plurality of video signal lines, and selected horizontal scanning period by horizontal scanning period; a plurality of pixel electrodes provided at respective intersections of the plurality of video signal lines and the plurality of scanning signal lines; and a plurality of auxiliary capacitance wiring lines arranged so as to intersect the plurality of video signal lines to form auxiliary capacitances with the plurality of pixel electrodes, and that displays an image based on an input signal on the display unit by applying the video signals to the plurality of video signal lines such that voltages determined based on the input signal representing gray scale values are provided to the pixel electrodes, the drive method comprising:

an output gray scale correction step of determining second output gray scales associated with video signal voltages to be applied to the plurality of video signal lines, by correcting first output gray scales determined based on line data on a line-data-by-line-data basis, the line data being data for one horizontal scanning period included in the input signal, wherein when a horizontal scanning period during which the video signals are to be applied to the plurality of video signal lines based on line data subjected to a process of determining the second output gray scales is defined as a processing target horizontal scanning period, and a horizontal scanning period immediately before the processing target horizontal scanning period is defined as a preceding horizontal scanning period, the output gray scale correction step includes:

a sum-total-of-voltage-difference calculation step of determining, as a sum total of voltage differences, a sum total of differences, for the plurality of video signal lines, between video signal voltages associated with second output gray scales determined based on line data for the preceding horizontal scanning period and video signal voltages associated with first output gray scales determined based on line data for the processing target horizontal scanning period; and a second output gray scale calculation step of determining the second output gray scales based on the sum total of voltage differences.

According to a tenth aspect of the present invention, in the ninth aspect of the present invention, in the second output gray scale calculation step, when the sum total of voltage differences has a positive value, the second output gray scale is set to a value greater than or equal to the first output gray scale, and when the sum total of voltage differences has a negative value, the second output gray scale is set to a value less than or equal to the first output gray scale, for data corresponding to a pixel electrode to which a positive voltage is to be applied during the processing target horizontal scanning period out of the line data, and when the sum total of voltage differences has a positive value, the second output gray scale is set to a value less than or equal to the first output gray scale, and when the sum total of voltage differences has a negative value, the second output gray scale is set to a value greater than or equal to the first output gray scale, for data corresponding to a pixel electrode to which a negative voltage is to be applied during the processing target horizontal scanning period out of the line data.

According to an eleventh aspect of the present invention, in the ninth aspect of the present invention, the drive method further comprises a gray scale value obtaining step of determining, as the first output gray scales, a first output gray scale for bright display for performing relatively bright display and a first output gray scale for dark display for performing relatively dark display, based on the gray scale values represented by respective data included in the input signal, wherein a one-screen image is displayed over a plurality of frame periods, and when taking a look at each data included in the input signal, during one-half of the plurality of frame periods, a video signal voltage associated with a second output gray scale determined by correcting the first output gray scale for bright display is applied to a pixel electrode associated with the data, and during remaining half of the plurality of frame periods, a video signal voltage associated with a second output gray scale determined by correcting the first output gray scale for dark display is applied to the pixel electrode associated with the data.

Effects of the Invention

According to a first aspect of the present invention, gray scale values (second output gray scales) for determining video signal voltages are determined by correcting gray scale values (first output gray scales) obtained based on an input signal. Specifically, second output gray scales are determined by correcting first output gray scales, based on the sum total of changes in video signal voltage (the sum total of voltage differences) for all video signal lines between two consecutive horizontal scanning periods which are obtained assuming that a correction has not been made. Here, the sum total of changes in video signal voltage for all video signal lines between the two consecutive horizontal scanning periods is proportional to the magnitude of a ripple (CS ripple) occurring in an auxiliary capacitance wiring line. Therefore, by making a correction by taking into account the sum total of voltage differences in the above-described manner, even when changes occur in pixel electrode voltages after completion of the period of writing to each line due to a CS ripple, the changed pixel electrode voltages can be made close to voltages to be originally applied to the pixel electrodes. Hence, by suitably correcting gray scale values, the occurrence of horizontal lines on a screen is suppressed, the horizontal lines conventionally occurring when there is bias in changes in video signal voltage.

According to a second aspect of the present invention, second output gray scales are determined by correcting first output gray scales by taking into account in advance the directions of changes in pixel electrode voltage caused by a CS ripple. Hence, the occurrence of horizontal lines on a screen is more effectively suppressed.

According to a third aspect of the present invention, second output gray scales are determined such that the larger the magnitude of a CS ripple which is expected to occur when a correction has not been made, the greater the correction made to first output gray scales. Hence, the occurrence of horizontal lines on a screen is further effectively suppressed.

According to a fourth aspect of the present invention, by a configuration in which a correspondence relationship between a "combination of a value corresponding to the sum total of voltage differences and a first output gray scale" and a "correction addition/subtraction value which is a value used to correct the first output gray scale" is stored in a look-up table, the circuit is prevented from becoming complex.

According to a fifth aspect of the present invention, a correction addition/subtraction value for determining a second output gray scale is multiplied by a multiplying factor determined according to the position in the display unit. Hence, second output gray scales are determined while taking into account the difference in the speed of CS ripple attenuation that depends on the position in the display unit. By this, in all lines, the occurrence of horizontal lines on a screen is more effectively suppressed, the horizontal lines conventionally occurring due to CS ripples.

According to a sixth aspect of the present invention, by a configuration in which a correspondence relationship between a position in the display unit and a multiplying factor is stored in a look-up table, the circuit is prevented from becoming complex.

In a liquid crystal display device adopting a time-division scheme, since bias is likely to occur in changes in video signal voltage between two consecutive horizontal scanning periods, horizontal lines on a screen caused by CS ripples are likely to occur. However, according to a seventh aspect of the present invention, in a liquid crystal display device adopting a time-division scheme, the occurrence of horizontal lines on a screen is effectively suppressed.

In a liquid crystal display device that performs image display using a part of the display unit, bias is likely to occur in changes in video signal voltage when a writing line is switched, for example, from the background display unit to the image display unit (or from the image display unit to the background display unit). Thus, horizontal lines on a screen caused by CS ripples are likely to occur. However, according to an eighth aspect of the present invention, in a liquid crystal display device that performs image display using a part of the display unit, the occurrence of horizontal lines on a screen is effectively suppressed.

According to a ninth aspect of the present invention, the same effect as that obtained in the first aspect of the present invention can be provided in the drive method for a liquid crystal display device.

According to a tenth aspect of the present invention, the same effect as that obtained in the second aspect of the present invention can be provided in the drive method for a liquid crystal display device.

According to an eleventh aspect of the present invention, the same effect as that obtained in the seventh aspect of the present invention can be provided in the drive method for a liquid crystal display device.

BRIEF DESCRIPTION OF THE DRAWINGS

FIG. 5 is a diagram showing an exemplary configuration of a gray scale value-voltage conversion look-up table in the embodiment.

FIG. 6 is a diagram showing an exemplary configuration of a positive-polarity background look-up table in the embodiment.

FIG. 7 is a diagram showing an exemplary configuration of a negative-polarity background look-up table in the embodiment.

FIG. 10 is a diagram showing an exemplary configuration of an in-plane distribution correction look-up table in a first variant of the embodiment.

MODE FOR CARRYING OUT THE INVENTION

An embodiment of the present invention will be described below with reference to the accompanying drawings.

<1. Overall Configuration and Operation>

Figure 2:
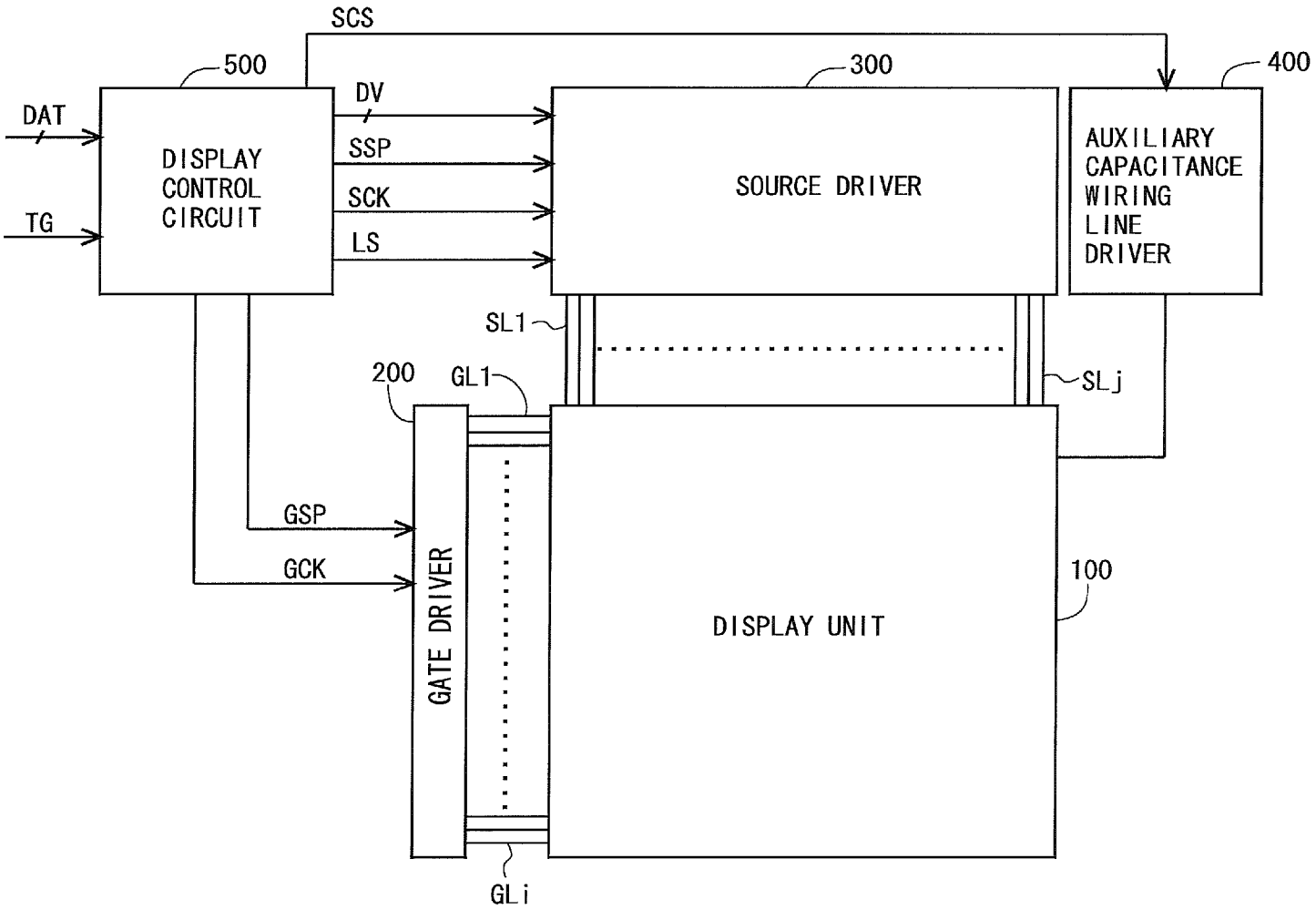
FIG. 2 is a block diagram showing an overall configuration of the liquid crystal display device in the embodiment.

FIG. 2 is a block diagram showing an overall configuration of an active matrix-type liquid crystal display device according to an embodiment of the present invention. As shown in FIG. 2, the liquid crystal display device includes a display unit 100, a gate driver (scanning signal line drive circuit) 200, a source driver (video signal line drive circuit) 300, an auxiliary capacitance wiring line driver 400, and a display control circuit 500.

In the display unit 100, a plurality of (i) gate bus lines (scanning signal lines) GL1 to GLi, a plurality of (j) source bus lines (video signal lines) SL1 to SLj, and a plurality of (i×j) picture element portions provided at the respective intersections of the gate bus lines GL1 to GLi and the source bus lines SL1 to SLj are formed. The plurality of picture element portions are arranged in a matrix, forming a pixel array.

Figure 3:
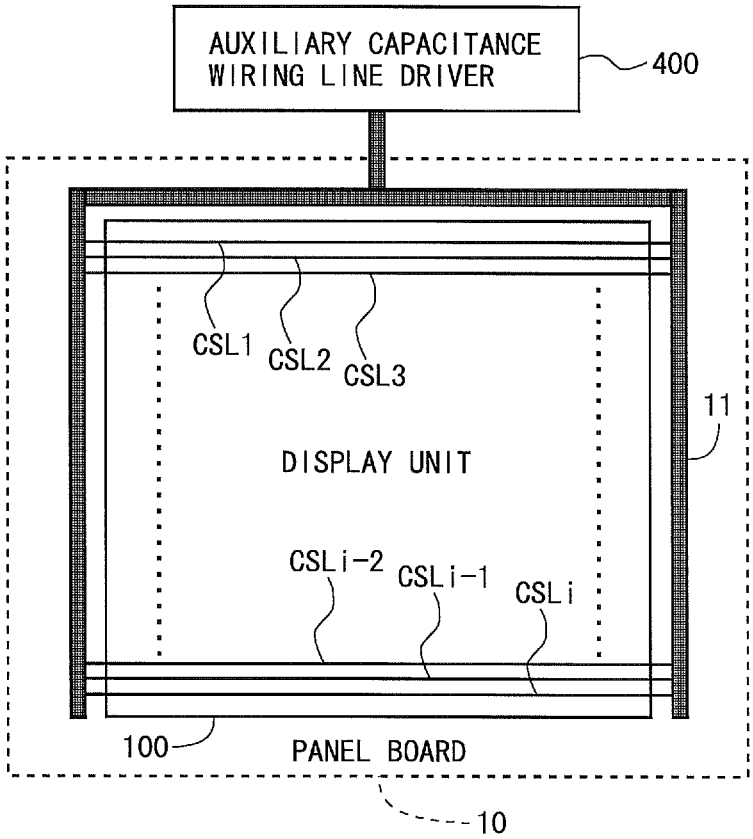
FIG. 3 is a diagram for describing CS bus lines and a CS main line in the embodiment.

In the display unit 100, as shown in FIG. 3, a plurality of (i) CS bus lines (auxiliary capacitance wiring lines) CSL1 to CSLi are also formed in a one-to-one correspondence with the gate bus lines GL1 to GLi. The CS bus lines are arranged so as to extend in parallel with the gate bus lines. A CS main line 11 is arranged in a region outside the display unit 100 on a panel board 10, as a component for providing desired voltages to the CS bus lines CSL1 to CSLi. Each CS bus line is connected to the CS main line 11 near both edges of the display unit 100. In addition, the CS main line 11 is connected to the auxiliary capacitance wiring line driver 400. By this configuration, the CS bus lines CSL1 to CSLi and the auxiliary capacitance wiring line driver 400 are connected to each other through the CS main line 11.

Figure 25:
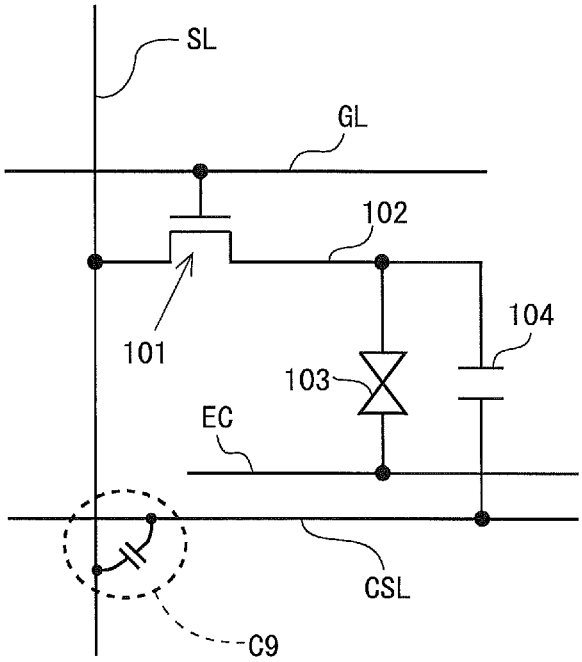
FIG. 25 is a circuit diagram showing a configuration of a picture element portion in the liquid crystal display device.
Figure 26:
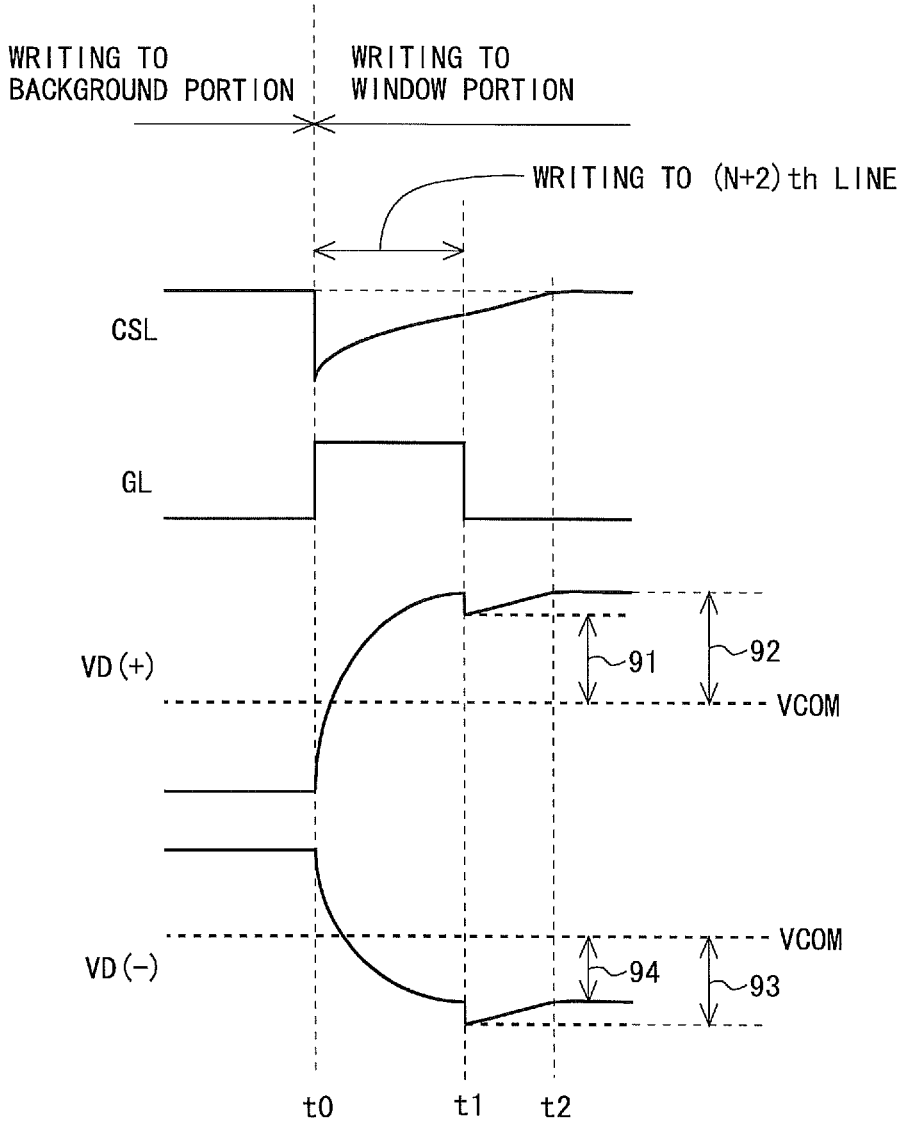
FIG. 26 is a diagram for describing the occurrence of horizontal lines on the screen.
Figure 27:
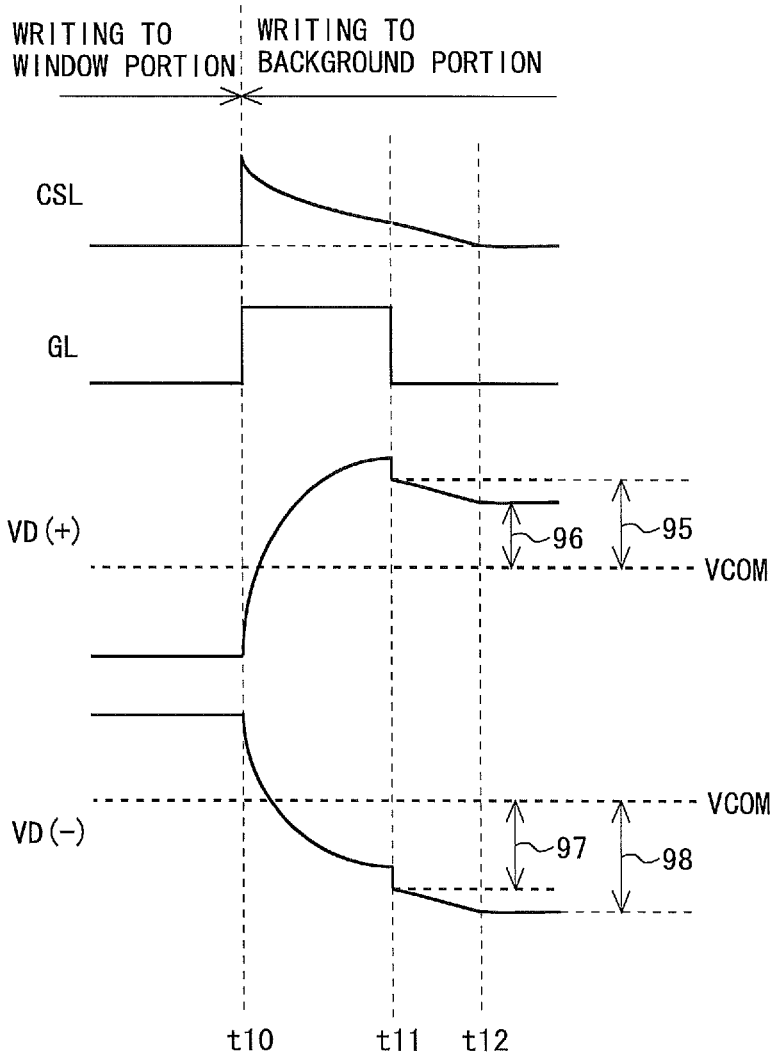
FIG. 27 is a diagram for describing the occurrence of horizontal lines on the screen.
Figure 28:
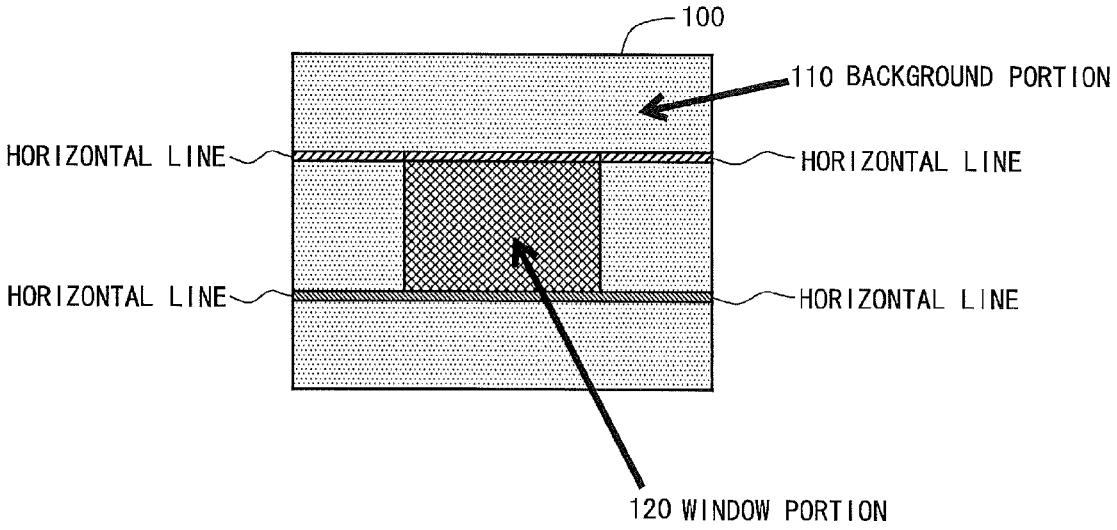
FIG. 28 is a diagram for describing the occurrence of horizontal lines on the screen.

FIG. 25 is a circuit diagram showing a configuration of a picture element portion. As shown in FIG. 25, each picture element portion is composed of a gate bus line GL; a source bus line SL; a common electrode EC; a CS bus line CSL; a thin-film transistor (TFT) 101 connected at its gate electrode to the gate bus line GL and connected at its source electrode to the source bus line SL; a pixel electrode 102 connected to the drain electrode of the thin-film transistor 101; a liquid crystal capacitance 103 formed by the pixel electrode 102 and the common electrode EC; and an auxiliary capacitance 104 formed by the pixel electrode 102 and the CS bus line CSL. In addition, a pixel capacitance is formed by the liquid crystal capacitance 103 and the auxiliary capacitance 104. In such a configuration, a voltage representing a pixel value is held in the pixel capacitance, based on a video signal which is received by the source electrode of the thin-film transistor 101 from the source bus line SL when the gate electrode of the thin-film transistor 101 receives an active scanning signal from the gate bus line GL.

Figure 14:
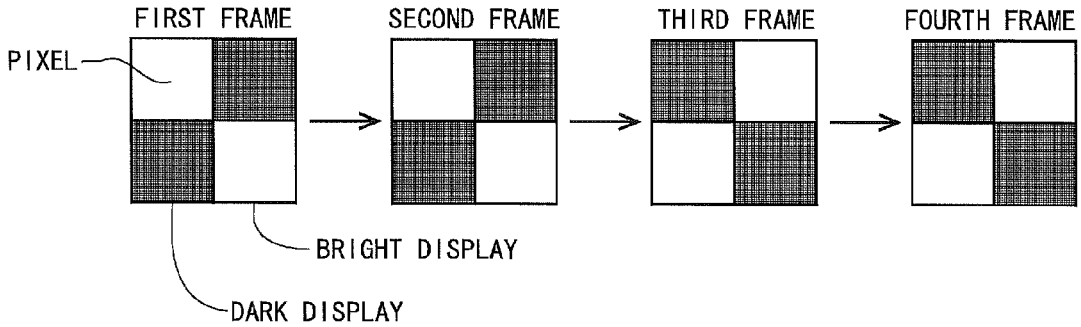
FIG. 14 is a diagram showing an example of changes in the display state in a liquid crystal display device adopting a time-division scheme.
Figures 17, 18:
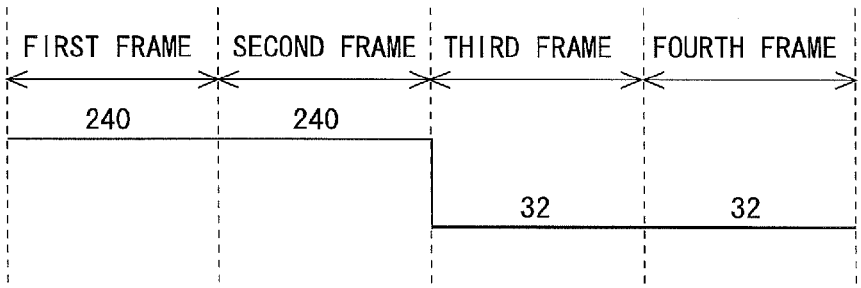
FIG. 17 is a diagram schematically showing an example of a gray scale value conversion look-up table.
FIG. 18 is a diagram showing an example of changes in the output gray scale in a liquid crystal display device adopting the time-division scheme.
Figure 19:
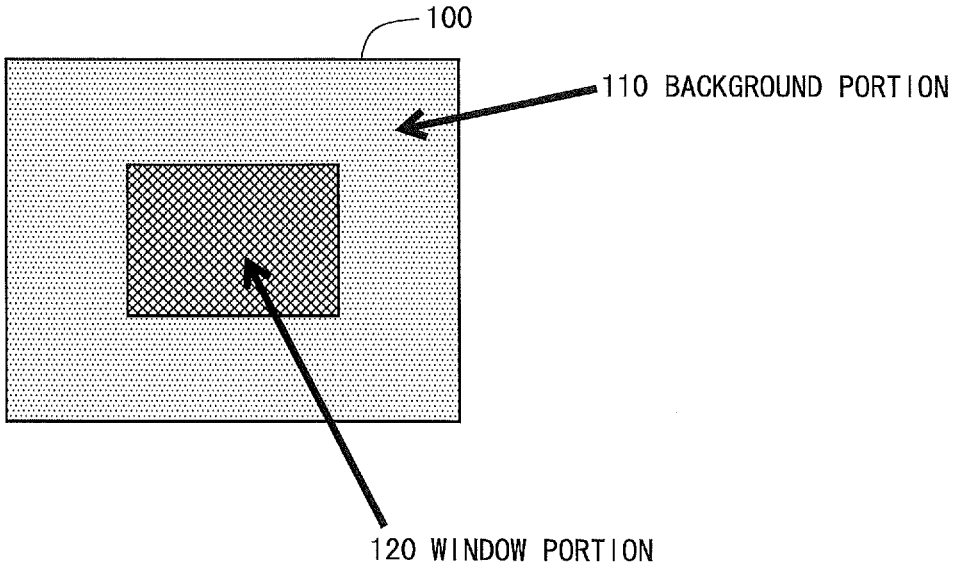
FIG. 19 is a diagram showing an exemplary configuration of a display unit in a liquid crystal display device.
Figure 20:
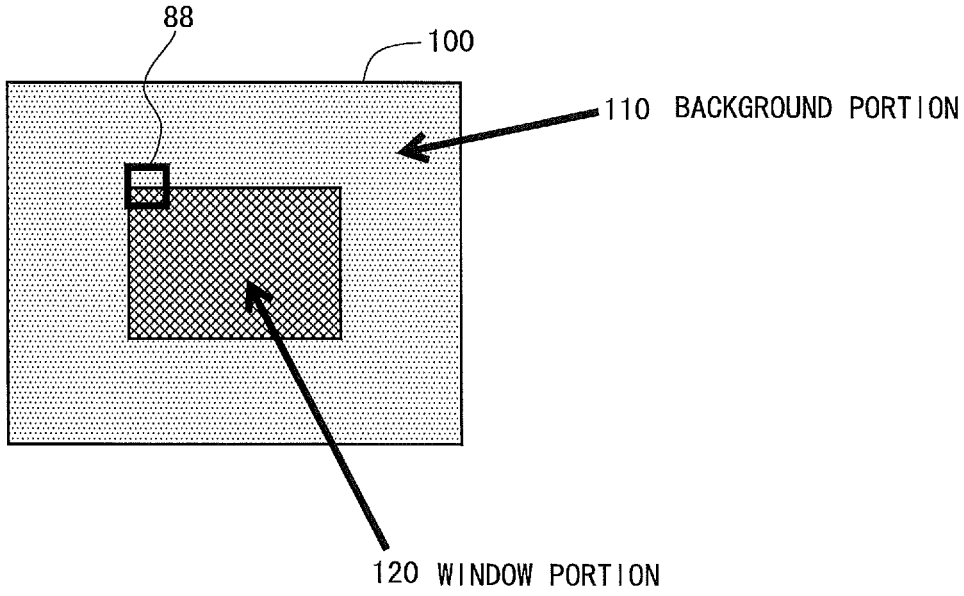
FIG. 20 is a diagram for describing the occurrence of horizontal lines on a screen.
Figure 21:
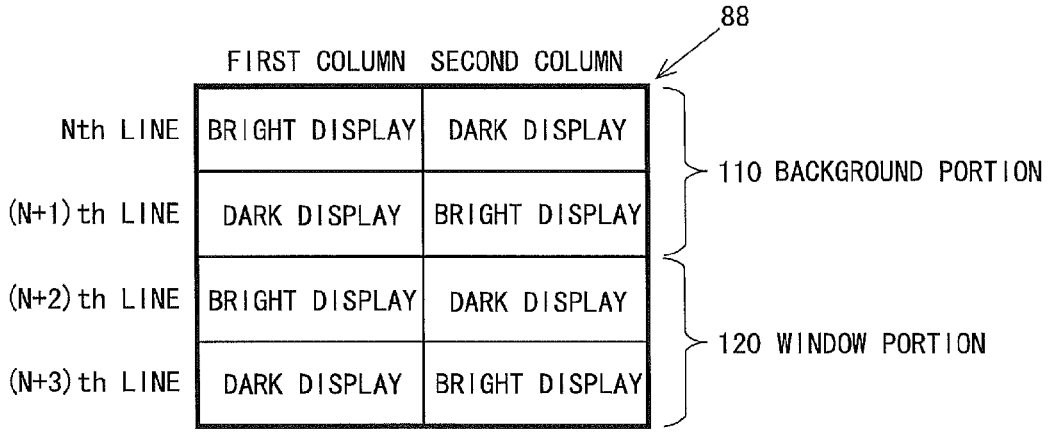
FIG. 21 is a diagram for describing the occurrence of horizontal lines on the screen.
Figure 22:
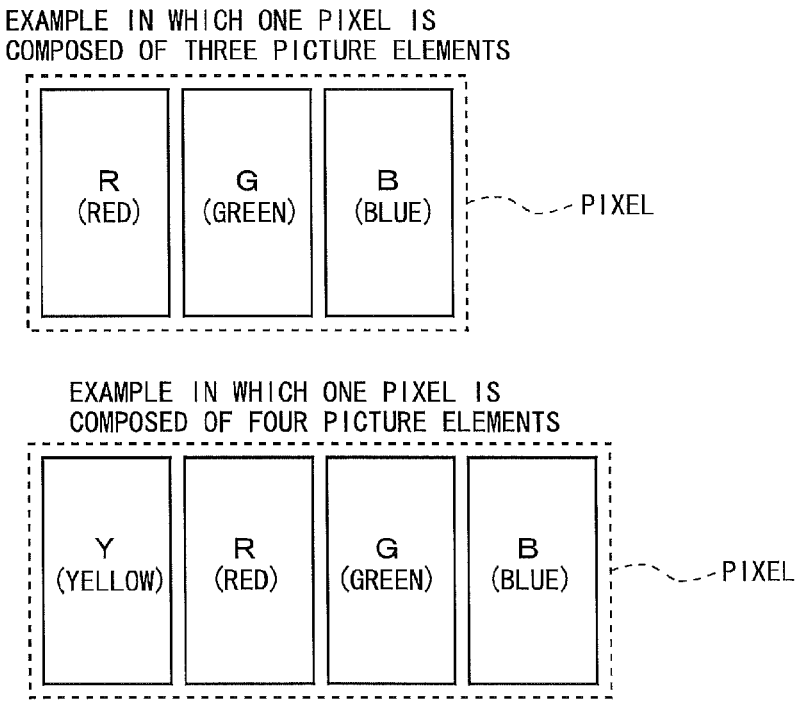
FIG. 22 is a diagram showing an example in which one pixel is composed of a plurality of picture elements.
Figure 23:
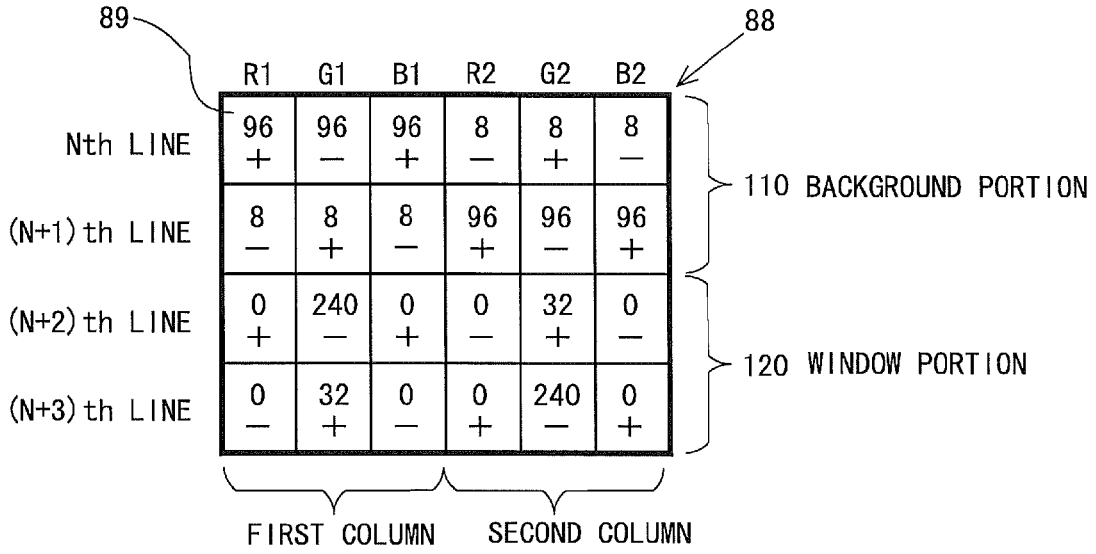
FIG. 23 is a diagram for describing the occurrence of horizontal lines on the screen.
Figure 24:
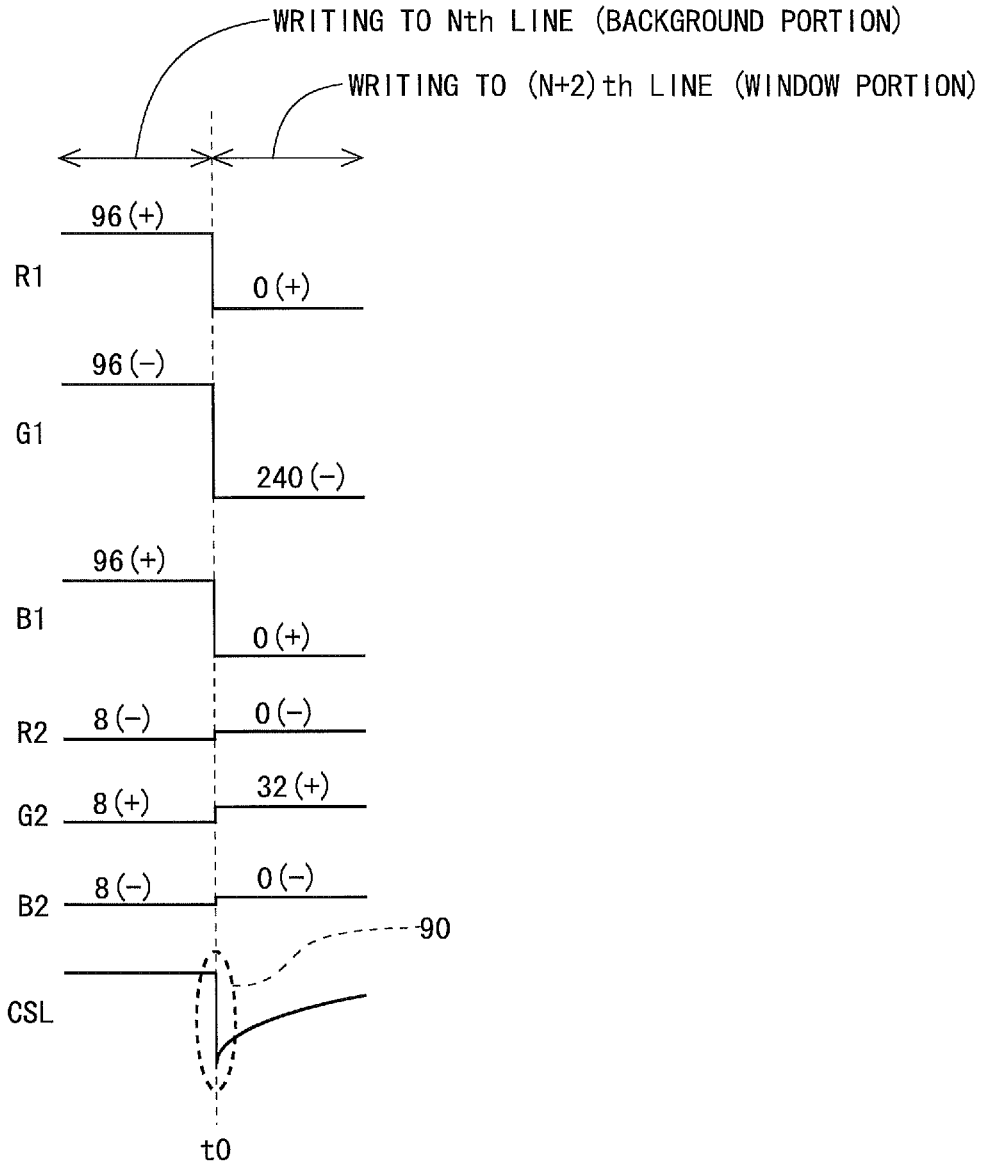
FIG. 24 is a diagram for describing the occurrence of horizontal lines on the screen.

Meanwhile, the liquid crystal display device according to the present embodiment adopts a time-division scheme as a technique for improving viewing angle characteristics. A unit period for displaying a one-screen image consists of four frames (see FIGS. 14 and 18). In addition, during the operation of the liquid crystal display device, as shown in FIG. 19, a window portion 120 for displaying an image is provided at a central portion of the display unit 100, and a background portion 110 for displaying background color is provided around the window portion 120. In addition, it is assumed that one pixel is composed of three picture elements, red (R), green (G), and blue (B). Note that in the present embodiment a first display unit is implemented by the background portion 110, and a second display unit is implemented by the window portion 120.

Next, the operation of the components shown in FIG. 2 will be described. The display control circuit 500 receives an image signal DAT and a timing signal group TG such as a horizontal synchronizing signal, a vertical synchronizing signal, and the like which are sent from an external source, and outputs a digital video signal DV, a gate start pulse signal GSP and a gate clock signal GCK for controlling the operation of the gate driver 200, a source start pulse signal SSP, a source clock signal SCK, and a latch strobe signal LS for controlling the operation of the source driver 300, and a CS bus line control signal SCS for controlling the operation of the auxiliary capacitance wiring line driver 400.

The gate driver 200 receives the gate start pulse signal GSP and the gate clock signal GCK which are outputted from the display control circuit 500, and applies scanning signals to the gate bus lines, respectively. Note that in the present embodiment the gate driver 200 selects the gate bus lines every other row. Specifically, the gate bus lines are placed in a selected state in order of "the first line, the third line, . . . , the (i−3)th line, the (i−1)th line, the second line, the fourth line, . . . , the (i−2)th line, and the ith line". The source driver 300 receives the digital video signal DV, the source start pulse signal SSP, the source clock signal SCK, and the latch strobe signal LS which are outputted from the display control circuit 500, and applies driving video signals to the source bus lines, respectively. The auxiliary capacitance wiring line driver 400 controls voltages to be applied to the CS bus lines CSL, based on the CS bus line control signal SCS outputted from the display control circuit 500.

In the above-described manner, while voltages applied to the CS bus lines CSL are controlled, scanning signals are applied to the gate bus lines GL, respectively, and driving video signals are applied to the source bus lines SL, respectively, so that an image based on the image signal DAT which are sent from the external source is displayed on the display unit 100.

<2. Configuration of the Display Control Circuit>

Figure 4:
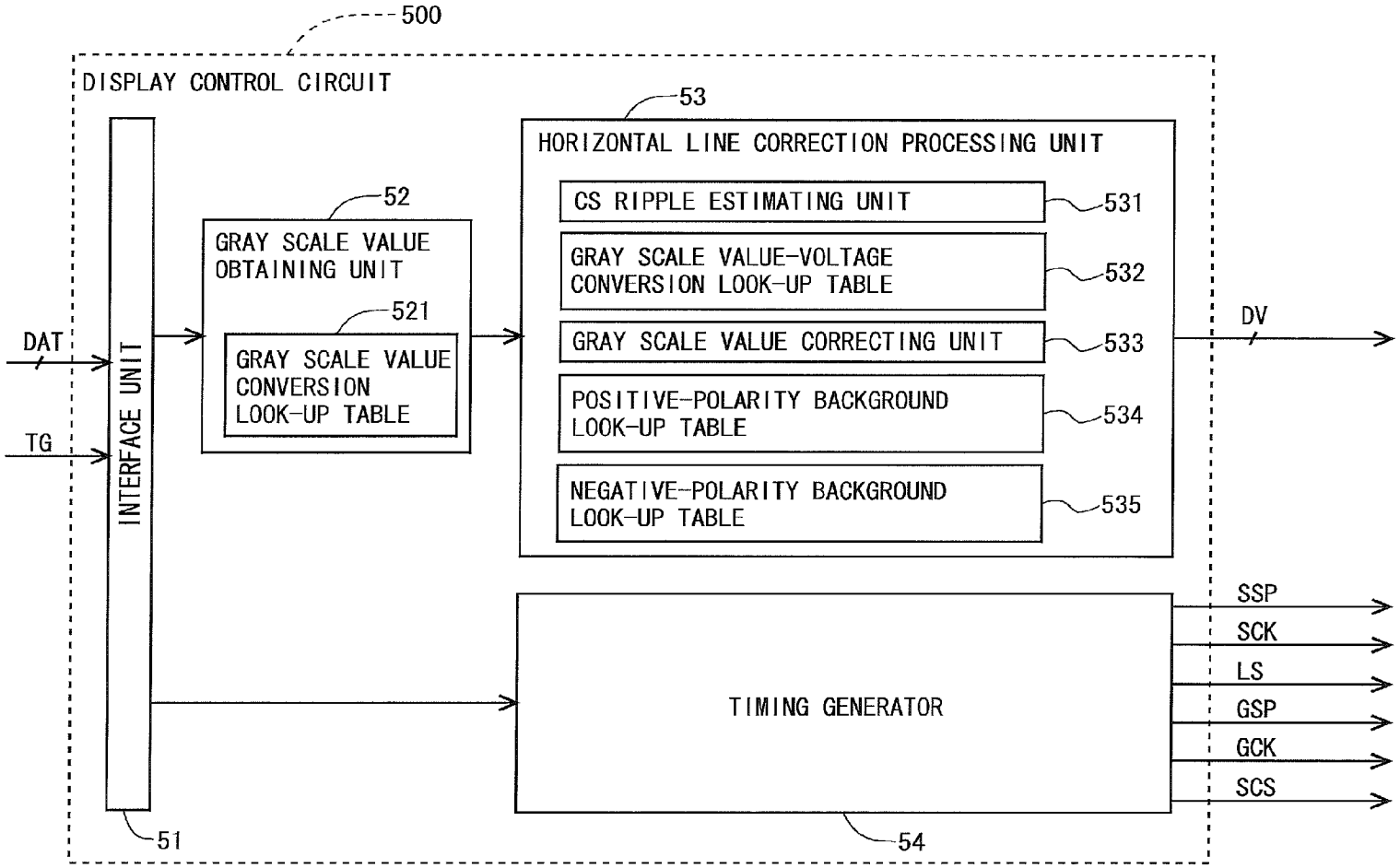
FIG. 4 is a block diagram showing a configuration of a display control circuit in the embodiment.

FIG. 4 is a block diagram showing a configuration of the display control circuit 500 in the present embodiment. The display control circuit 500 includes an interface unit 51, a gray scale value obtaining unit 52, a horizontal line correction processing unit 53, and a timing generator 54. The gray scale value obtaining unit 52 includes a gray scale value conversion look-up table 521. The horizontal line correction processing unit 53 includes a CS ripple estimating unit 531, a gray scale value-voltage conversion look-up table 532, a gray scale value correcting unit 533, a positive-polarity background look-up table 534, and a negative-polarity background look-up table 535.

The interface unit 51 receives an image signal DAT and a timing signal group TG from an external source, and appropriately provides the image signal DAT and the timing signal group TG to the gray scale value obtaining unit 52 and the timing generator 54. The gray scale value obtaining unit 52 obtains output gray scales for bright pixels (first output gray scales for bright display) and output gray scales for dark pixels (first output gray scales for dark display), based on input gray scales which are gray scales represented by the image signal DAT, by referring to the gray scale value conversion look-up table 521. Note that, as described above, the gray scale value conversion look-up table 521 stores data in which input gray scales and output gray scales for bright and dark pixels are associated with each other (see FIG. 17).

The horizontal line correction processing unit 53 corrects the gray scale values obtained by the gray scale value obtaining unit 52 (i.e., the output gray scales obtained from the gray scale value conversion look-up table 521) to suppress the occurrence of horizontal lines on a screen caused by CS ripples, and outputs the corrected gray scale values as a digital video signal DV. Note that in the following the gray scale values obtained by the gray scale value obtaining unit 52 are referred to as "first output gray scales", and the gray scale values obtained in the correction process by the horizontal line correction processing unit 53 are referred to as "second output gray scales". The gray scale value-voltage conversion look-up table 532 stores data in which gray scale values and source voltages are associated with each other. FIG. 5 is a diagram showing an exemplary configuration of the gray scale value-voltage conversion look-up table 532. For example, a row indicated by an arrow denoted by reference character 71 indicates that "when the gray scale value is 10, the source voltage is 9.11 V for writing at a picture element portion where the polarity is to be made positive, and the source voltage is 5.33 V for writing at a picture element portion where the polarity is to be made negative". The CS ripple estimating unit 531 estimates the magnitudes of CS ripples occurring in the respective CS bus lines CSL by referring to the gray scale value-voltage conversion look-up table 532. A numerical representation of the magnitude of a CS ripple is hereinafter referred to as the "CS ripple amount".

The positive-polarity background look-up table 534 and the negative-polarity background look-up table 535 store data in which "combinations of the CS ripple amount and a background gray scale" and "correction addition/subtraction values" are associated with each other. Note that the correction addition/subtraction values are values used in arithmetic processing for determining second output gray scales in a horizontal line correction process which will be described later. FIG. 6 is a diagram showing an exemplary configuration of the positive-polarity background look-up table 534. FIG. 7 is a diagram showing an exemplary configuration of the negative-polarity background look-up table. For example, data denoted by reference character 72 in FIG. 6 represents that "when the CS ripple amount is −7925, the correction addition/subtraction value is −83 for a picture element with a background gray scale of 696. The gray scale value correcting unit 533 determines correction addition/subtraction values by referring to the positive-polarity background look-up table 534 and the negative-polarity background look-up table 535 based on the CS ripple amount estimated by the CS ripple estimating unit 531, and determines second output gray scales for the respective picture elements, using the correction addition/subtraction values. Note that specific content of processes performed by the CS ripple estimating unit 531 and the gray scale value correcting unit 533 will be described later. Note also that in the following the positive-polarity background look-up table 534 and the negative-polarity background look-up table 535 are also collectively referred to as the "polarity-by-polarity background look-up table".

The timing generator 54 generates the above-described source start pulse signal SSP, source clock signal SCK, latch strobe signal LS, gate start pulse signal GSP, gate clock signal GCK, and CS bus line control signal SCS, and outputs those signals.

Note that in the present embodiment an output gray scale correction processing unit is implemented by the horizontal line correction processing unit 53, and an output gray scale correction look-up table is implemented by the positive-polarity background look-up table 534 and the negative-polarity background look-up table 535.

<3. Horizontal Line Correction Process>

Figure 1:
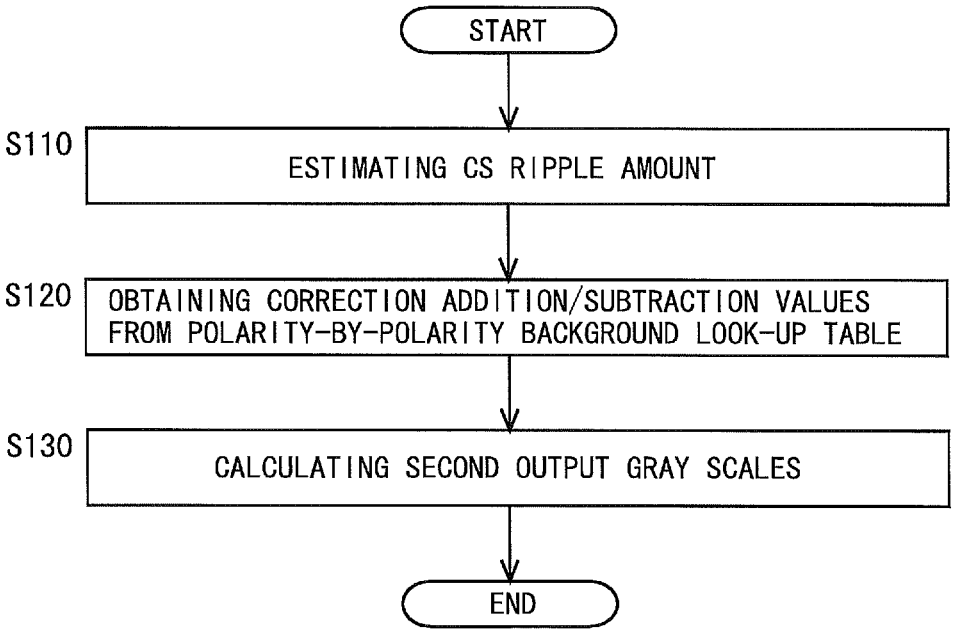
FIG. 1 is a flowchart showing the procedure of a horizontal line correction process in an active matrix-type liquid crystal display device according to an embodiment of the present invention.

Next, a horizontal line correction process which is a process for suppressing the occurrence of horizontal lines on a screen caused by CS ripples will be described. FIG. 1 is a flowchart showing the procedure of the horizontal line correction process in the present embodiment. Note that the horizontal line correction process is performed by the above-described horizontal line correction processing unit 53. Note also that FIG. 1 shows a procedure for one line, and the processes at steps S110 to S130 are repeated during the operation of the liquid crystal display device.

When first output gray scales for one-line data (line data) are obtained by the gray scale value obtaining unit 52, the CS ripple estimating unit 531 estimates the magnitude of a CS ripple (the CS ripple amount) occurring in a CS bus line CSL provided in association with a line (processing target line) for which the first output gray scales have been obtained (step S110). Specifically, the CS ripple estimating unit 531 first determines, for each source bus line SL, a difference between a "source voltage for a horizontal scanning period which is immediately before a horizontal scanning period during which the processing target line is placed in a selected state" and a "source voltage determined based on a first output gray scale obtained by the gray scale value obtaining unit 52" (hereinafter, referred to as the "source voltage change amount"). At that time, to convert the first output gray scale obtained by the gray scale value obtaining unit 52 into a source voltage, the CS ripple estimating unit 531 refers to the gray scale value-voltage conversion look-up table 532 such as that shown in FIG. 5. Then, the CS ripple estimating unit 531 determines the sum total of the source voltage change amounts for all source bus lines SL. The sum total of the source voltage change amounts is hereinafter referred to as the "source voltage change amount for one line". Note that the horizontal scanning period during which the processing target line is placed in a selected state corresponds to a processing target horizontal scanning period, and the horizontal scanning period which is immediately before the processing target horizontal scanning period corresponds to a preceding horizontal scanning period. Note also that the source voltage change amount for one line corresponds to the sum total of voltage differences.

For example, when the Mth line is the processing target in a liquid crystal display device having 1920 pixels in the horizontal direction, the source voltage change amount for one line is determined as follows. In the present embodiment, since one pixel is composed of three picture elements and the gate bus lines GL are placed in a selected state every other row, the sum total of differences between "the source voltage for a horizontal scanning period during which writing to the (M−2)th line is performed" and "the source voltage for the Mth line which are obtained by referring to the gray scale value-voltage conversion look-up table 532 based on the first output gray scale obtained by the gray scale value obtaining unit 52" for 5760 source bus lines SL is determined as the source voltage change amount for one line. Here, for determination of the amounts of change in source voltage, it is correct in principle to refer to voltages obtained after correction for data of the (M−2)th line. Thus, "the source voltage for a horizontal scanning period during which writing to the (M−2)th line is performed" is a voltage based on the second gray scale. Note that when the source voltage change amount for one line has a positive value, by performing writing to the processing target line, a CS ripple occurs such that the voltage of the CS bus line CSL increases. On the other hand, when the source voltage change amount for one line has a negative value, by performing writing to the processing target line, a CS ripple occurs such that the voltage of the CS bus line CSL decreases.

Figure 8:
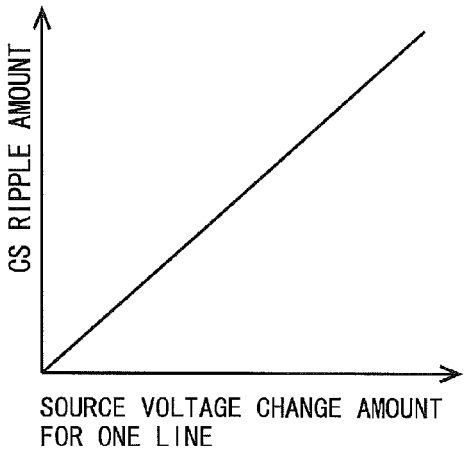
FIG. 8 is a graph showing a relationship between the CS ripple amount and the source voltage change amount for one line in the embodiment.

Meanwhile, the CS ripple amount and the source voltage change amount for one line have a proportional relationship such as that shown in FIG. 8. Therefore, the CS ripple amount which is expected to occur in the CS bus line CSL can be estimated based on the source voltage change amount for one line. Hence, in the present embodiment, the CS ripple estimating unit 531 estimates the CS ripple amount from the source voltage change amount for one line determined in the above-described manner. In the above-described manner, at step S110, the estimation of the CS ripple amount by the CS ripple estimating unit 531 is performed.

Then, the gray scale value correcting unit 533 obtains correction addition/subtraction values for the respective picture elements included in the processing target line from the polarity-by-polarity background look-up table, based on the CS ripple amount determined at step S110 (step S120). Upon obtaining the correction addition/subtraction values, the positive-polarity background look-up table 534 is referred to for a picture element where the polarity is to be made positive, and the negative-polarity background look-up table 535 is referred to for a picture element where the polarity is to be made negative. In the above-described manner, at step S120, obtaining of correction addition/subtraction values for the respective picture elements by the gray scale value correcting unit 533 is performed.

Then, the gray scale value correcting unit 533 calculates second output gray scales (step S130). Specifically, the gray scale value correcting unit 533 calculates second output gray scales for the respective picture elements included in the processing target line, based on the gray scale values (first output gray scales) obtained by the gray scale value obtaining unit 52 and the correction addition/subtraction values obtained at step S120. For example, when the gray scale value obtained by the gray scale value obtaining unit 52 is 15 and the correction addition/subtraction value obtained at step S120 is 3, the second output gray scale is 18. In addition, for example, when the gray scale value obtained by the gray scale value obtaining unit 52 is 696 and the correction addition/subtraction value obtained at step S120 is −55, the second output gray scale is 641. In the above-described manner, at step S130, calculation of second output gray scales for the respective picture elements by the gray scale value correcting unit 533 is performed. By thus calculating the second output gray scales, the horizontal line correction process ends. The second output gray scales determined in the horizontal line correction process are, as described above, outputted from the display control circuit 500 as a digital video signal DV.

Note that although in the polarity-by-polarity background look-up table (the positive-polarity background look-up table 534 and the negative-polarity background look-up table 535) shown in FIGS. 6 and 7, the CS ripple amount is on the horizontal axis, the source voltage change amount for one line may be on the horizontal axis. Since the CS ripple amount and the source voltage change amount for one line have a proportional relationship as described above, a value corresponding to the source voltage change amount for one line can be placed on the horizontal axis of the polarity-by-polarity background look-up table.

<4. Effects>

According to the present embodiment, in a liquid crystal display device that adopts a time-division scheme to improve viewing angle characteristics, after obtaining gray scale values (first output gray scales) for bright and dark pixels based on an input signal (image signal DAT), gray scale values (second output gray scales) for determining source voltages for writing in picture element portions included in a processing target line are determined by correcting the gray scale values for bright and dark pixels in the following manner. First, the magnitude of a CS ripple (the CS ripple amount) is estimated, the CS ripple being expected to occur in a CS bus line CSL upon writing to the processing target line when it is assumed that a correction has not been made. The estimation of the CS ripple amount is performed by adding all of the differences between "the source voltage for a horizontal scanning period which is immediately before a horizontal scanning period during which writing to the processing target line is performed" and "the source voltage associated with the output gray scale based on the input signal" for all source bus lines SL. Then, the output gray scales are corrected using the correction addition/subtraction values stored in the polarity-by-polarity background look-up table, according to the magnitude of the CS ripple amount. Here, the polarity-by-polarity background look-up table stores data in the manner shown below.

(1) The larger the CS ripple amount (absolute value), the larger the correction addition/subtraction value (absolute value).

(2) The positive and negative of the correction addition/subtraction values are determined such that a change in pixel electrode voltage caused by a CS ripple is cancelled out, specifically, as shown in (2-1) and (2-2).

(2-1) For a picture element where the polarity is to be made positive, when the CS ripple amount has a positive value, the correction addition/subtraction value is a positive value, and when the CS ripple amount has a negative value, the correction addition/subtraction value is a negative value.

(2-2) For a picture element where the polarity is to be made negative, when the CS ripple amount has a positive value, the correction addition/subtraction value is a negative value, and when the CS ripple amount has a negative value, the correction addition/subtraction value is a positive value.

Figure 15:
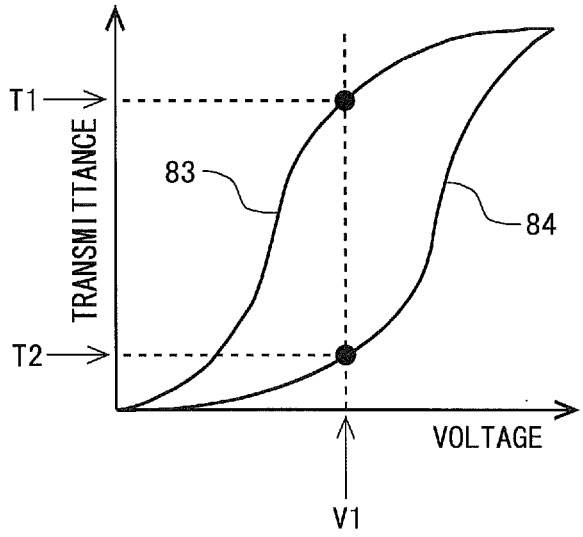
FIG. 15 is a graph for describing the voltage-transmittance characteristics in a liquid crystal display device adopting the space-division scheme or the time-division scheme.
Figure 16:
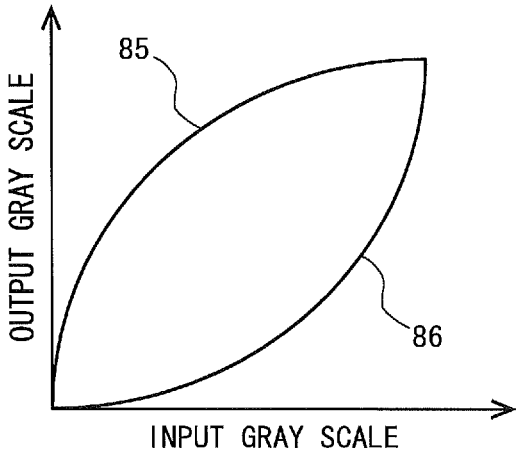
FIG. 16 is a graph for describing relationships between an input gray scale and an output gray scale in the liquid crystal display device adopting the space-division scheme or the time-division scheme.

(3) The correction addition/subtraction value (absolute value) for a background gray scale corresponding to the neighborhood of a rise (inflection point) of a VT curve (see FIG. 15) is relatively large.

Figure 9:
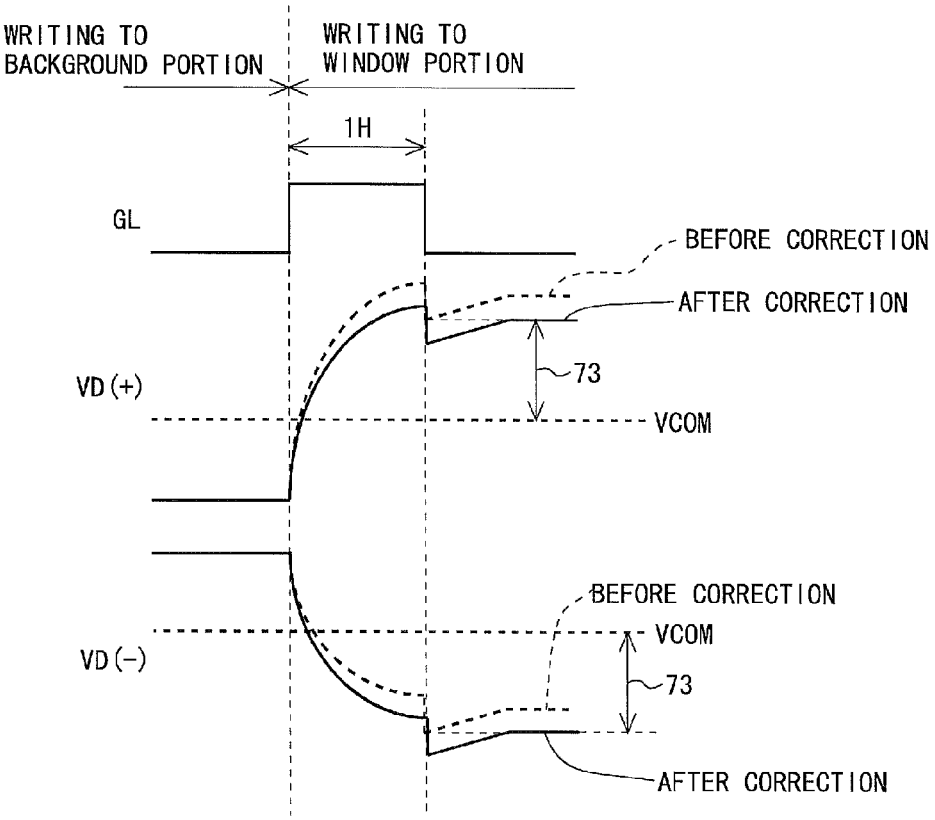
FIG. 9 is a signal waveform diagram for describing an effect obtained in the embodiment.

Thus, by correcting the output gray scales while taking into account the source voltage change amount for one line and the directions of changes in pixel electrode voltage based on the source voltage change amount for one line, driving video signals are applied to the source bus lines SL corresponding to the respective picture element portions such that changes in pixel electrode voltages caused by a CS ripple are cancelled out at the picture element portions. Hence, even when changes in output gray scales are relatively large like when transitioning from the period of writing to the background portion 110 to the period of writing to the window portion 120 (or from the period of writing to the window portion 120 to the period of writing to the background portion 110), the pixel electrode voltage is close to a voltage to be originally applied to the pixel electrode at each picture element portion. As a result, at both of a picture element portion where the polarity is to be made positive and a picture element portion where the polarity is to be made negative, a voltage of a magnitude to be originally applied to the liquid crystal layer (voltage of a magnitude denoted by reference character 73 in FIG. 9) is applied to the liquid crystal layer. Accordingly, the occurrence of horizontal lines on a screen is suppressed, the horizontal lines conventionally occurring in a liquid crystal display device adopting a time-division scheme.

<5. Variants>

Variants of the embodiment will be described below.

<5.1 First Variant>

In general, desired voltages are supplied to the CS bus lines CSL1 to CSLi, respectively, through the CS main line 11 from the auxiliary capacitance wiring line driver 400 provided on one side of the display unit 100 (see FIG. 3). Due to such a configuration, the load is different between the upper portion of the display unit 100 and the lower portion of the display unit 100. In addition, even on the same line, the load is different between the central portion of the display unit 100 and the edge portions of the display unit 100. Hence, the speed of CS ripple attenuation is different depending on the position in the display unit 100. As a result, even when output gray scales are corrected using correction addition/subtraction values obtained from the polarity-by-polarity background look-up table, the effect of suppressing the occurrence of horizontal lines may be small. In view of this, in the present variant, the configuration is such that the horizontal line correction processing unit 53 further includes a look-up table (hereinafter, referred to as the "in-plane distribution correction look-up table") such as that shown in FIG. 10 so that an output gray scale is corrected by the correction amount which varies depending on the position in the display unit 100 even when the source voltage changes in the same manner. When, for example, signals to be provided to the CS bus lines are inputted from the upper portion of the display unit 100 as shown in FIG. 3, the CS ripple amount is relatively small in the upper area of the display unit 100, and is relatively large in the lower area of the display unit 100. Therefore, in the upper area of the display unit 100, since the correction amount may be small, the values (correction multiplying factors) in the in-plane distribution correction look-up table are set to be small. In the lower area of the display unit 100, since the correction amount needs to be large, the values (correction multiplying factors) in the in-plane distribution correction look-up table are set to be large. Note that a multiplying factor look-up table is implemented by the in-plane distribution correction look-up table.

Figure 11:
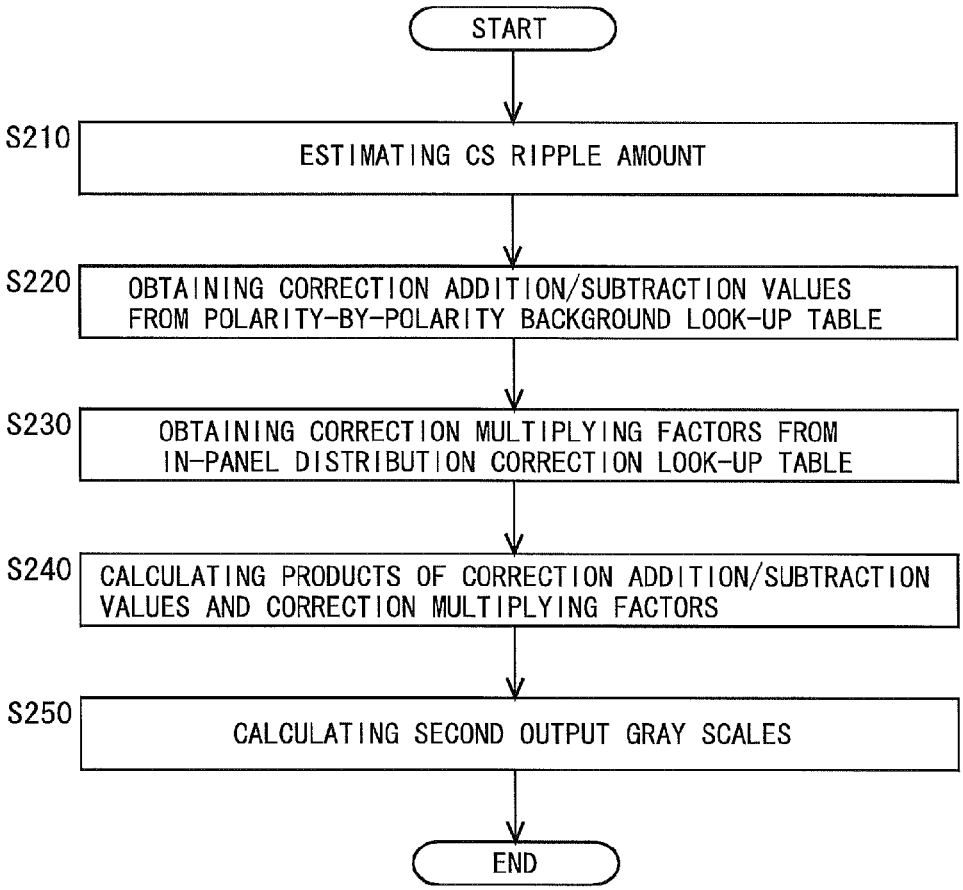
FIG. 11 is a flowchart showing the procedure of a horizontal line correction process in the first variant of the embodiment.

FIG. 11 is a flowchart showing the procedure of a horizontal line correction process in the present variant. At step S210, as with step S110 in the above-described embodiment, the CS ripple amount is estimated. Then, at step S220, as with step S120 in the above-described embodiment, correction addition/subtraction values are obtained. Furthermore, at step S230, the gray scale value correcting unit 533 obtains correction multiplying factors for the respective picture elements included in the processing target line from the in-plane distribution correction look-up table. Then, at step S240, the gray scale value correcting unit 533 obtains the products of the correction addition/subtraction values obtained at step S220 and the correction multiplying factors obtained at step S230.

Thereafter, at step S250, second output gray scales are calculated based on gray scale values (first output gray scales) obtained by the gray scale value obtaining unit 52 and the values (the products of the correction addition/subtraction values and the correction multiplying factors) obtained at step S240. For example, when the gray scale value obtained by the gray scale value obtaining unit 52 is 15 and the value obtained at step S240 is 2, the second output gray scale is 17. In addition, for example, when the gray scale value obtained by the gray scale value obtaining unit 52 is 696 and the value obtained at step S240 is −35, the second output gray scale is 661. In the above-described manner, at step S250, calculation of second output gray scales for the respective picture elements by the gray scale value correcting unit 533 is performed.

According to the present variant, output gray scales (gray scale values obtained by the gray scale value obtaining unit 52) based on an input signal are corrected while taking into account the difference in the speed of CS ripple attenuation that depends on the position in the display unit 100, by which gray scale values (second output gray scales) for determining source voltages are determined. Hence, in all lines, the occurrence of horizontal lines on a screen is more effectively suppressed, the horizontal lines conventionally occurring due to CS ripples.

<5.2 Second Variant>

Although in the above-described embodiment one pixel is composed of three picture elements, the present invention is not limited thereto. The present invention can also be applied to, for example, a liquid crystal display device in which one pixel is composed of four picture elements, yellow (Y), red (R), green (G), and blue (B). In this case, when there are 1920 pixels in the horizontal direction and the Mth line is the processing target, in order to estimate the CS ripple amount, the sum total of differences between "the source voltage for a horizontal scanning period during which writing to the (M−2) th line is performed" and "the source voltage for the Mth line which are obtained by referring to the gray scale value-voltage conversion look-up table 532 based on output gray scales (first output gray scales) obtained by the gray scale value obtaining unit 52" for 7680 source bus lines SL is determined as the source voltage change amount for one line.

<5.3 Others>

Although in the above-described embodiment the configuration is such that the gate bus lines GL are selected every other row, the present invention is not limited thereto. Even when the configuration is such that the gate bus lines GL are sequentially selected row by row, the present invention can be applied thereto. In addition, although in the above-described embodiment the display unit 100 is composed of the background portion 110 and the window portion 120, the present invention is not limited thereto. The present invention can also be applied to a liquid crystal display device that displays still images and moving images using the entire display unit 100. Furthermore, the present invention can also be applied to a liquid crystal display device that adopts a space-division scheme in addition to a time-division scheme to improve viewing angle characteristics. Moreover, the internal configuration of the display control circuit 500 for performing a horizontal line correction process is not limited to the configuration shown in the above-described embodiment (the configuration in FIG. 4).

Figure 12:
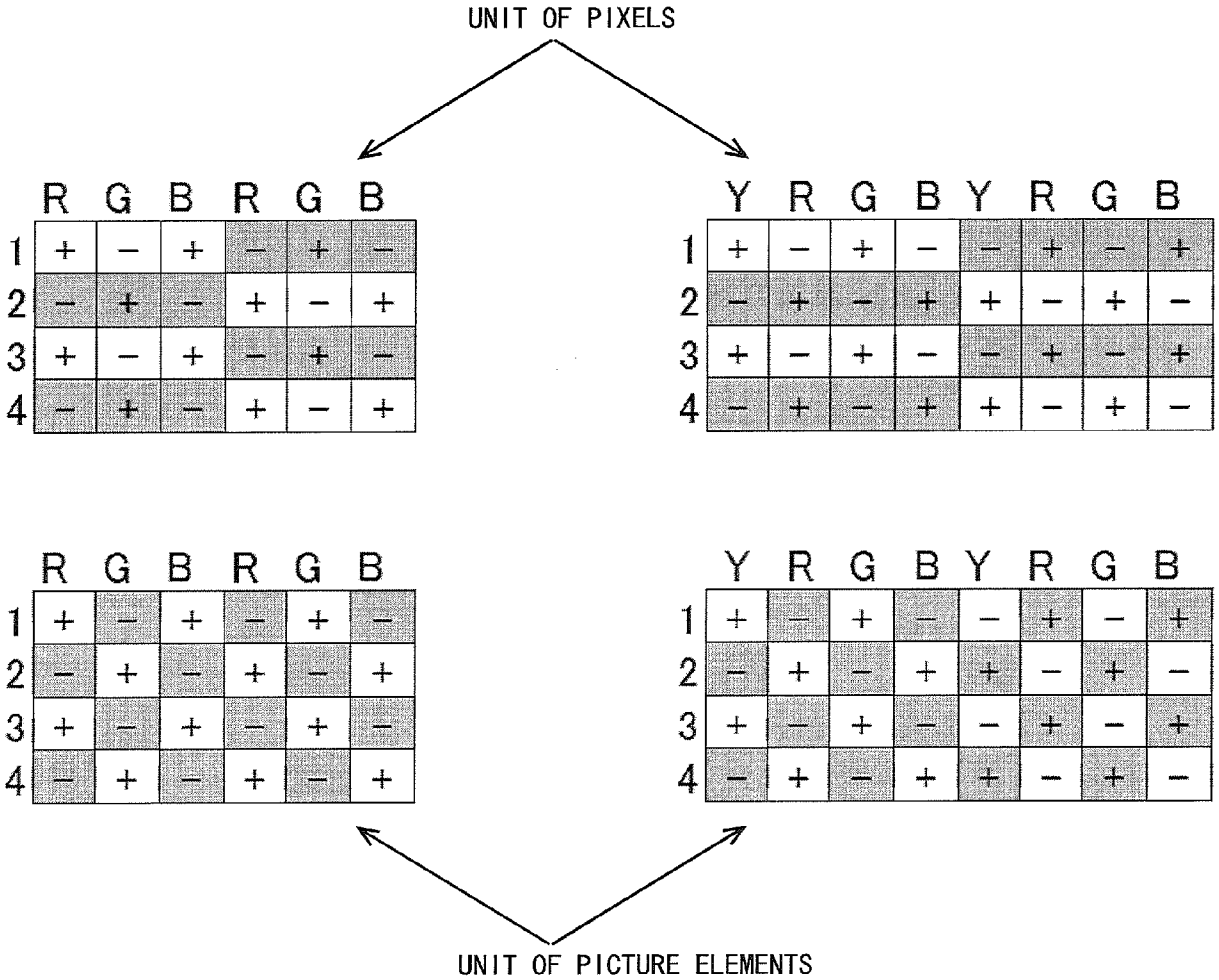
FIG. 12 is a diagram for describing the arrangements of "bright" and "dark" in a variant of the embodiment.
Figure 13:
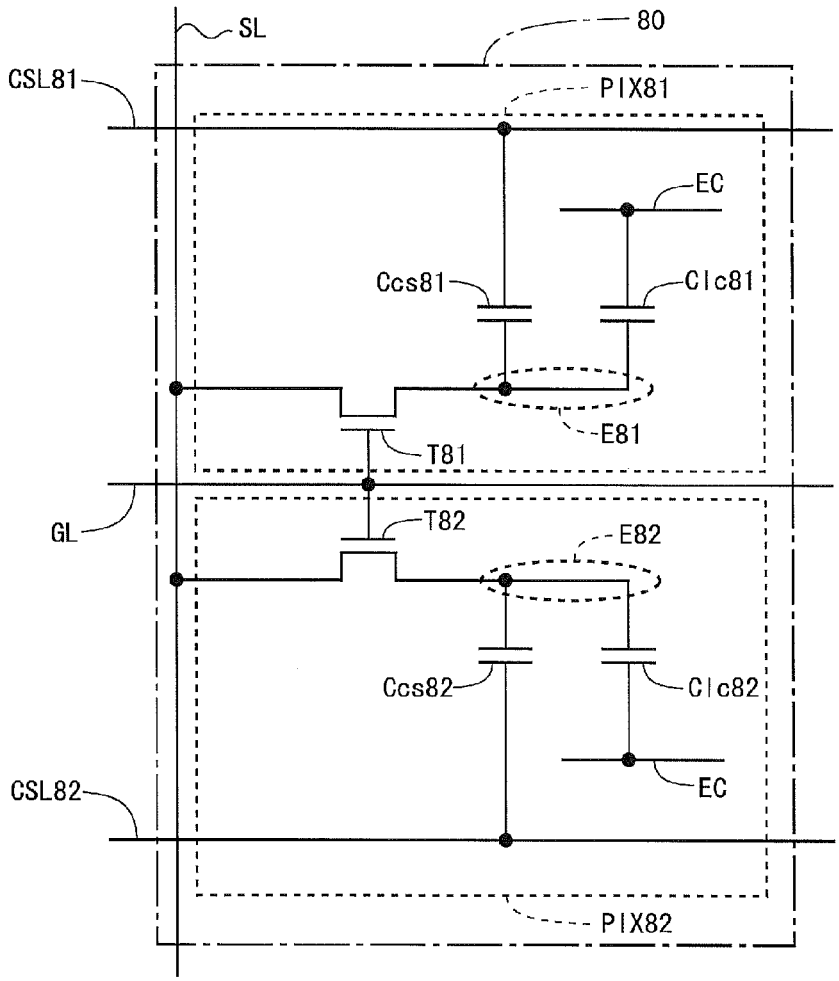
FIG. 13 is a circuit diagram showing a configuration of a picture element portion in a liquid crystal display device adopting a space-division scheme.

In addition, although in the above-described embodiment a unit period for displaying a one-screen image consists of four frames, the number of frames composing the unit period is not particularly limited. Furthermore, although in the above-described embodiment bright pixels and dark pixels are arranged on a pixel-to-pixel basis in both of the vertical direction (column direction) and the horizontal direction (row direction) in each frame, the present invention is not limited thereto. Bright pixels and dark pixels may be arranged on a plurality-of-pixel-to-plurality-of-pixel basis in both of the vertical direction and the horizontal direction or in one of the vertical direction and the horizontal direction. Moreover, although in the above-described embodiment "bright" and "dark" are arranged in the unit of pixels, the present invention is not limited thereto, and "bright" and "dark" may be arranged in the unit of picture elements (see FIG. 12).

In addition, as for various types of look-up tables described in the above-described embodiment and variants, the intervals between data values may be set appropriately, and thus are not limited to those described in the above-described embodiment and variants. Data between data values set in the look-up table may be computed by, for example, a linear interpolation process or a non-linear process according to characteristics.

DESCRIPTION OF REFERENCE CHARACTERS

10: PANEL BOARD
52: GRAY SCALE VALUE OBTAINING UNIT
53: HORIZONTAL LINE CORRECTION PROCESSING UNIT
100: DISPLAY UNIT
200: GATE DRIVER
300: SOURCE DRIVER
400: AUXILIARY CAPACITANCE WIRING LINE DRIVER
500: DISPLAY CONTROL CIRCUIT
531: CS RIPPLE ESTIMATING UNIT
532: GRAY SCALE VALUE-VOLTAGE CONVERSION LOOK-UP TABLE
533: GRAY SCALE VALUE CORRECTING UNIT
534: POSITIVE-POLARITY BACKGROUND LOOK-UP TABLE
535: NEGATIVE-POLARITY BACKGROUND LOOK-UP TABLE
CSL: CS BUS LINE (AUXILIARY CAPACITANCE WIRING LINE)
GL: GATE BUS LINE (SCANNING SIGNAL LINE)
SL: SOURCE BUS LINE (VIDEO SIGNAL LINE)

The invention claimed is:

1. A liquid crystal display device that includes a display unit including: a plurality of video signal lines for transmitting video signals; a plurality of scanning signal lines arranged so as to intersect the plurality of video signal lines, and selected horizontal scanning period by horizontal scanning period; a plurality of pixel electrodes provided at respective intersections of the plurality of video signal lines and the plurality of scanning signal lines; and a plurality of auxiliary capacitance wiring lines arranged so as to intersect the plurality of video signal lines to form auxiliary capacitances with the plurality of pixel electrodes, and that displays an image based on an input signal on the display unit by applying the video signals to the plurality of video signal lines such that voltages determined based on the input signal representing gray scale values are provided to the pixel electrodes, the liquid crystal display device comprising:

an output gray scale correction processing unit that determines second output gray scales associated with video signal voltages to be applied to the plurality of video signal lines, by correcting first output gray scales determined based on line data on a line-data-by-line-data basis, the line data being data for one horizontal scanning period included in the input signal, wherein when a horizontal scanning period during which the video signals are to be applied to the plurality of video signal lines based on line data subjected to a process of determining the second output gray scales is defined as a processing target horizontal scanning period, a horizontal scanning period immediately before the processing target horizontal scanning period is defined as a preceding horizontal scanning period, and a sum total of differences, for the plurality of video signal lines, between video signal voltages associated with second output gray scales determined based on line data for the preceding horizontal scanning period and video signal voltages associated with first output gray scales determined based on line data for the processing target horizontal scanning period is defined as a sum total of voltage differences, the output gray scale correction processing unit determines the second output gray scales by correcting the first output gray scales, based on the sum total of voltage differences.

2. The liquid crystal display device according to claim 1, wherein the output gray scale correction processing unit:

sets the second output gray scale to a value greater than or equal to the first output gray scale when the sum total of voltage differences has a positive value, and sets the second output gray scale to a value less than or equal to the first output gray scale when the sum total of voltage differences has a negative value, for data corresponding to a pixel electrode to which a positive voltage is to be applied during the processing target horizontal scanning period out of the line data; and sets the second output gray scale to a value less than or equal to the first output gray scale when the sum total of voltage differences has a positive value, and sets the second output gray scale to a value greater than or equal to the first output gray scale when the sum total of voltage differences has a negative value, for data corresponding to a pixel electrode to which a negative voltage is to be applied during the processing target horizontal scanning period out of the line data.

3. The liquid crystal display device according to claim 2, wherein when there are a plurality of data whose values of the first output gray scales are equal, the output gray scale correction processing unit makes a difference between the first output gray scale and the second output gray scale larger for a larger absolute value of the sum total of voltage differences, for the plurality of data.

4. The liquid crystal display device according to claim 1, further comprising output gray scale correction look-up tables for the respective polarities of the voltages to be applied to the pixel electrodes, each of the output gray scale correction look-up tables storing a correspondence relationship between a combination of a value corresponding to the sum total of voltage differences and the first output gray scale, and a correction addition/subtraction value being a value used to correct the first output gray scale, wherein the output gray scale correction processing unit sets the second output gray scale to a value obtained by an addition/subtraction process of a correction addition/subtraction value and the first output gray scale, the correction addition/subtraction value being obtained from the output gray scale correction look-up tables based on a combination of a value corresponding to the sum total of voltage differences and the first output gray scale.

5. The liquid crystal display device according to claim 4, wherein the output gray scale correction processing unit multiplies the correction addition/subtraction value by a multiplying factor determined in advance according to a position in the display unit, before performing the addition/subtraction process of the correction addition/subtraction value and the first output gray scale.

6. The liquid crystal display device according to claim 5, further comprising a multiplying factor look-up table storing a correspondence relationship between a position in the display unit and a multiplying factor used to correct the correction addition/subtraction value, wherein the output gray scale correction processing unit multiplies the correction addition/subtraction value by a multiplying factor obtained from the multiplying factor look-up table based on a position in the display unit for each data.

7. The liquid crystal display device according to claim 1, further comprising a gray scale value obtaining unit that determines, as the first output gray scales, a first output gray scale for bright display for performing relatively bright display and a first output gray scale for dark display for performing relatively dark display, based on the gray scale values represented by respective data included in the input signal, wherein a one-screen image is displayed over a plurality of frame periods, and when taking a look at each data included in the input signal, during one-half of the plurality of frame periods, a video signal voltage associated with a second output gray scale determined by correcting the first output gray scale for bright display is applied to a pixel electrode associated with the data, and during remaining half of the plurality of frame periods, a video signal voltage associated with a second output gray scale determined by correcting the first output gray scale for dark display is applied to the pixel electrode associated with the data.

8. The liquid crystal display device according to claim 1, wherein the display unit includes a first display unit that performs display of an image based on a constant gray scale value; and a second display unit that performs display of an image based on any gray scale, the second display unit being in a region other than the first display unit.

9. A drive method for a liquid crystal display device that includes a display unit including: a plurality of video signal lines for transmitting video signals; a plurality of scanning signal lines arranged so as to intersect the plurality of video signal lines, and selected horizontal scanning period by horizontal scanning period; a plurality of pixel electrodes provided at respective intersections of the plurality of video signal lines and the plurality of scanning signal lines; and a plurality of auxiliary capacitance wiring lines arranged so as to intersect the plurality of video signal lines to form auxiliary capacitances with the plurality of pixel electrodes, and that displays an image based on an input signal on the display unit by applying the video signals to the plurality of video signal lines such that voltages determined based on the input signal representing gray scale values are provided to the pixel electrodes, the drive method comprising:

an output gray scale correction step of determining second output gray scales associated with video signal voltages to be applied to the plurality of video signal lines, by correcting first output gray scales determined based on line data on a line-data-by-line-data basis, the line data being data for one horizontal scanning period included in the input signal, wherein when a horizontal scanning period during which the video signals are to be applied to the plurality of video signal lines based on line data subjected to a process of determining the second output gray scales is defined as a processing target horizontal scanning period, and a horizontal scanning period immediately before the processing target horizontal scanning period is defined as a preceding horizontal scanning period, the output gray scale correction step includes:

a sum-total-of-voltage-difference calculation step of determining, as a sum total of voltage differences, a sum total of differences, for the plurality of video signal lines, between video signal voltages associated with second output gray scales determined based on line data for the preceding horizontal scanning period and video signal voltages associated with first output gray scales determined based on line data for the processing target horizontal scanning period; and a second output gray scale calculation step of determining the second output gray scales based on the sum total of voltage differences.

10. The drive method according to claim 9, wherein in the second output gray scale calculation step, when the sum total of voltage differences has a positive value, the second output gray scale is set to a value greater than or equal to the first output gray scale, and when the sum total of voltage differences has a negative value, the second output gray scale is set to a value less than or equal to the first output gray scale, for data corresponding to a pixel electrode to which a positive voltage is to be applied during the processing target horizontal scanning period out of the line data, and when the sum total of voltage differences has a positive value, the second output gray scale is set to a value less than or equal to the first output gray scale, and when the sum total of voltage differences has a negative value, the second output gray scale is set to a value greater than or equal to the first output gray scale, for data corresponding to a pixel electrode to which a negative voltage is to be applied during the processing target horizontal scanning period out of the line data.

11. The drive method according to claim 9, further comprising a gray scale value obtaining step of determining, as the first output gray scales, a first output gray scale for bright display for performing relatively bright display and a first output gray scale for dark display for performing relatively dark display, based on the gray scale values represented by respective data included in the input signal, wherein a one-screen image is displayed over a plurality of frame periods, and when taking a look at each data included in the input signal, during one-half of the plurality of frame periods, a video signal voltage associated with a second output gray scale determined by correcting the first output gray scale for bright display is applied to a pixel electrode associated with the data, and during remaining half of the plurality of frame periods, a video signal voltage associated with a second output gray scale determined by correcting the first output gray scale for dark display is applied to the pixel electrode associated with the data.

* * * * *